US008782925B2

(12) United States Patent
McManus et al.

(10) Patent No.: US 8,782,925 B2
(45) Date of Patent: Jul. 22, 2014

(54) ATHLETIC SHOE

(71) Applicant: Jennus Athletics Company, Mendota Heights, MN (US)

(72) Inventors: Timothy G. McManus, Mendota Heights, MN (US); Ryan G. McManus, Mendota Heights, MN (US)

(73) Assignee: Jennus Athletics Company, Mendota Heights, MN (US)

( * ) Notice: Subject to any disclaimer, the term of this patent is extended or adjusted under 35 U.S.C. 154(b) by 0 days.

(21) Appl. No.: 14/016,977

(22) Filed: Sep. 3, 2013

(65) Prior Publication Data

US 2014/0000128 A1 Jan. 2, 2014

(51) Int. Cl.
*A43B 23/00* (2006.01)
*A43B 5/00* (2006.01)

(52) U.S. Cl.
CPC ..... *A43B 5/00* (2013.01)
USPC ..... 36/45; 36/77 R; 36/102

(58) Field of Classification Search
USPC ..... 36/45, 77 R, 77 M, 97, 102, 8.4; 12/114.2, 115.2
See application file for complete search history.

(56) References Cited

U.S. PATENT DOCUMENTS 2,507,726 A * 5/1950 L Hollier et al. ..... 36/45
3,138,880 A 6/1964 Kunzli
4,060,869 A * 12/1977 Brown ..... 12/115.2
4,255,876 A 3/1981 Johnson
4,294,023 A 10/1981 Banford
4,354,319 A * 10/1982 Block et al. ..... 36/114
4,398,358 A * 8/1983 Hilton ..... 36/114
4,413,431 A 11/1983 Cavanagh
4,559,723 A 12/1985 Hamy et al.
4,811,497 A 3/1989 Merino Ciudad et al.
4,813,158 A 3/1989 Brown
5,259,126 A * 11/1993 Rosen ..... 36/93
5,377,430 A 1/1995 Hatfield
5,713,141 A 2/1998 Mitchell et al.

(Continued)

FOREIGN PATENT DOCUMENTS

EP 0090580 A1 10/1983
EP 2517587 A1 10/2012

OTHER PUBLICATIONS

Kolata, Gina, "Myths of Running: Forefoot, Barefoot and Otherwise," The New York Times, NYTimes.com, Oct. 15, 2012, 4 pages.

(Continued)

*Primary Examiner* — Marie Bays
(74) *Attorney, Agent, or Firm* — Merchant & Gould P.C.

(57) ABSTRACT

An athletic shoe configured to efficiently attenuate plantar loading forces is disclosed. The shoe toebox includes a region of increased stretchability aligned to intercept a big toe of a foot abruptly moving forward within the shoe. The increased stretchability region defines a damping passageway through the toebox material through which a front portion of the big toe can pass externally of an at rest outer peripheral surface of the toebox. The region of increased stretchability may include a cutout portion through the toebox with an associated elastic layer or web that stretches to open a passageway for the big toe into and through the cutout portion. The elastic layer can comprise porous material for ventilating the toebox while keeping foreign matter out, and urges refraction of material forming the cutout portion back toward its initial configuration upon retraction of the big toe from the passageway.

22 Claims, 11 Drawing Sheets

(56) References Cited

U.S. PATENT DOCUMENTS

| | | | | |
|---|---|---|---|---|
| 5,940,990 | A | 8/1999 | Barret et al. | |
| 6,029,376 | A | 2/2000 | Cass | |
| 6,351,897 | B1 | 3/2002 | Smith | |
| 6,367,169 | B1 | 4/2002 | Barret | |
| 6,763,614 | B2 | 7/2004 | Smith | |
| 6,820,354 | B1 | 11/2004 | Zanatta et al. | |
| 7,396,338 | B2 | 7/2008 | Huber et al. | |
| 7,543,397 | B2 | 6/2009 | Kilgore et al. | |
| 7,676,850 | B2 | 3/2010 | Steel | |
| 7,739,810 | B2 | 6/2010 | Luedecke et al. | |
| 7,805,860 | B2 | 10/2010 | Fliri | |
| 7,980,007 | B2 * | 7/2011 | Cook et al. | 36/97 |
| 8,413,349 | B2 | 4/2013 | Krauss | |
| 8,448,350 | B2 | 5/2013 | Nataadiningrat et al. | |
| 2001/0025438 | A1 * | 10/2001 | Abraham | 36/106 |
| 2002/0069558 | A1 | 6/2002 | Wilkinson | |
| 2006/0276737 | A1 | 12/2006 | Rose | |
| 2008/0163519 | A1 * | 7/2008 | Sartor et al. | 36/77 M |
| 2009/0014424 | A1 * | 1/2009 | Meschter | 219/121.69 |
| 2011/0252581 | A1 | 10/2011 | Teichert et al. | |
| 2012/0000094 | A1 | 1/2012 | Fliri | |
| 2012/0216426 | A1 | 8/2012 | Hixon | |
| 2012/0240431 | A1 | 9/2012 | Colclough | |
| 2012/0317841 | A1 | 12/2012 | Taylor et al. | |
| 2012/0322330 | A1 | 12/2012 | Takebe et al. | |

OTHER PUBLICATIONS

Larrondo, Ryan, "NFL Enlists Boise Doctor to Tackle Foot Injuries," Sports News. King Broadcasting Company, KTVB, Boise, Idaho, May 7, 2012; 2 pages.

Luna, Taryn, "A New Look for Runners Separates the Big Toe," The Boston Globe, Jul. 3, 2013, 4 pages.

Mailler, et al., "The Wear and Tear of 26.2: Dermatological Injuries Reported on Marathon Day." British Journal of Sports Medicine 38.4 (2004): pp. 498-501.

Mayo Clinic Staff. "Hammertoe and Mallet Toe," Mayo Clinic, Mayo Foundation for Medical Education and Research, Aug. 21, 2010, 5 pages.

Mayo Clinic Staff. "Ingrown Toenails." Mayo Clinic, Mayo Foundation for Medical Education and Research, Mar. 25, 2009, 5 pages.

"On Test: Shimano SH-R300 Road Shoes," Cycling News Jun. 13, 2008, 5 pages.

Parker-Pope, Tara. "Are Barefoot Shoes Really Better?" The New York Times. NYTimes.com, Sep. 30, 2011, 3 pages.

"Q&A with Former Broncos Wide Receiver Ed McCaffrey," Denver Broncos, DenverBroncos.com, Dec. 20, 2002, 5 pages.

Rosenberg, Todd, comp., "Larry Fitzgerald Sports Illustrated Cover," Sports Illustrated, Aug. 1, 2011, 2 pages. Cover Page. Sports Illustrated Vault.

Sanders, Jenny, DPM, "A Guide to Treating Common Soccer Injuries," Podiatry Today 25.9 (Sep. 2012); pp. 68-72. PodiatryToday.com, Sep. 2012.

"Sesamoiditis," American Academy of Orthopaedic Surgeons, OrthoInfo, Sep. 2012, 2 pages.

Smith, James D., comp., "Miles Austin Sports Illustrated Cover," Sports Illustrated, May 26, 2010, 1 page.

"Subungual Hematoma (Bleeding Under Nail): Causes and Treatments," WebMD. Copyright 2013 WebMD, 4 pages.

Vorvick, Linda, MD, "Ingrown Toenail: Onychocryptosis; Unguis Incamatus; Nail Avlusion; Matrix Excision," copyright 1997-2013 A.D.A.M., Inc., 5 pages.

Williams, Bruce E., DPM, "How to Treat Turf Toe Injuries," Podiatry Today 21.9 (Sep. 2008), pp. 38-43.

Wyatt, Jim, "Titans Cut Cleats to Take Heat off Toes," The Tennessean [Nashville, Tennessee] Aug. 16, 2007, Sports sec. 3 pages.

* cited by examiner

ATHLETIC SHOE

FIELD OF THE INVENTION

This invention relates generally to athletic shoes, and more particularly to an improved athletic shoe configured to distribute pressure applied to the foot to more efficiently attenuate plantar loading forces on the foot and to enhance comfort and improve ventilation within the shoe.

BACKGROUND OF THE INVENTION

Athletic shoes are used in a wide array of settings, from casual lifestyle wear to performance wear in athletic activities including, but not limited to: recreational walking, running, cross-training, football, soccer, basketball, tennis, lacrosse, rugby, cross-country, volleyball, running, racquetball, squash, handball and track and field. The athletic shoe segment of the footwear industry encompasses cleated and non-cleated shoes made from a variety of materials including, for example: rubber, plastics, leather, synthetics, composites, woven and non-woven fabrics, foams, gels, and the like—all designed for athletic use or in an athletic style. In general, shoe producers strive to improve the comfort, athletic performance and style of athletic footwear. In addition to social custom, athletic shoes are worn to provide protection to the foot while concurrently providing a competitive advantage by incorporating innovation and performance based technologies specifically tailored for task, terrain and function.

There have been a myriad of various technologies and methodologies that have propelled athletic shoes to their modern day presentations. While many of these developments have made improvements by reducing the weight of the shoe, there have also been advancements directed to its performance and comfort. In face of these improvements, modern athletic shoes still employ insufficient toebox designs that are restrictive and cause agitation to the toes during certain athletic maneuvers or movements, leading to discomfort and injury. Many athletes prefer to wear tight fitting shoes to gain greater control or to garner a better "feel". Unfortunately, in addition to wearing athletic shoe designs that employ insufficient toeboxes, wearing ill-fitting shoes further contributes to and places an individual at a greater risk for incurring a number of painful and sometimes debilitating injuries. Risk of injury in field sports has further increased with the advent of artificial turf fields and pliable athletic shoe designs, which contribute to the application of higher peak pressure forces to the foot and hallux during athletic performance. This has resulted in a significant increase of foot/toe injuries for athletes in various diverse sports.

There are a number of foot injuries that have plagued athletes, caused wholly or in part to interaction or movement of the foot within the shoe when worn by the athlete for its intended purpose. Such injuries are particularly prevalent where the foot or toes repeatedly impact or forcibly engage the toebox of the shoe during abrupt athletic footwork movements such as stopping, changing direction or cutting, and due to the use of tight or improperly fitting shoes.

One serious injury that may result from an inadequate toebox or ill-fitting shoe is referred to as "turf toe". The term "turf toe" is commonly used to refer to any serious injury to the hallux (big toe). Turf toe is often somewhat an ambiguous medical diagnosis, since as many toe injuries that appear similar in presentation to turf toe are inaccurately deemed as turf toe. The correct epidemiological definition of turf toe is a sprain of the first metatarsophalangeal joint ("MPJ" or "MTP joint"). The MPJ is the joint located at the base of the big toe and is used in pushing off with the foot. Damage to this joint occurs when the MPJ is jammed or hyperextended. Symptoms include: swelling, bruising, loss of range of motion, severe pain and sometimes an inability to bear weight. Turf toe most frequently occurs in athletes who compete on grass or turf playing surfaces when a player lands on the back lower leg of another player who has his/her foot plantar flexed at the angle with the big toe extended. Turf toe can also occur as an impaction injury where the proximal phalanx dorsally jams into the metatarsal head. Such impaction may transpire as a result of a direct blow to the big toe from another player or from a collision of the big toe against the shoe's restrictive toebox. Prolonged use of forefoot-limiting shoes and insoles places one at risk for an increased occurrence of turf toe. Turf toe is a debilitating injury and is often described by patients as being extremely painful and can keep athletes from returning to competition for significant periods of time. It commonly takes from two to six weeks for a turf toe injury to heal to a status such that one can return to a normal functioning level, and generally leaves the affected individual more susceptible to repeat injury. An external view of an inflamed MPJ turf toe injury is illustrated in FIG. 1.

Another common injury that often results from wearing a shoe with an inadequate toebox or improper shoe size is subungual hematoma, often referred to as "runner's toe", "jogger's toe", "tennis toe" or "soccer toe". Subungual hematoma is the collection of blood underneath a toenail, as illustrated in FIG. 2. For distance runners and joggers, subungual hematoma is often caused by the repetitive thrusting of the hallux against the toebox. The friction generated between the toebox and toenail contributes to nail plate separation from the nail bed, which leads to bleeding and pooling of blood. This in turn causes pressure buildup and tissue damage under the toenail. Subungual hematoma is also referred to as "black toenail" since it frequently results in a red/purple-black discoloration of the toenail, a common precursor to the nail itself falling off completely. Subungual hematoma is not only expressed in runners, but is also a common injury for athletes wearing cleated and non-cleated shoes during sport competitions such as football, soccer, lacrosse, rugby, racquetball, squash, tennis, volleyball and basketball—to name a few. During competition, athletes must frequently change direction, jump or come to a sudden stop by way of planting the foot in or on the playing surface. In planting one's foot to run, stop, jump, cut or change direction, the shoe is often momentarily fixed in or to the ground for a time causing the foot and toes to thrust or slide forward within the shoe, thus often abruptly engaging the inner toebox portion of the shoe. Such impact of the toes against the toebox is a likely suspect for subungual hematoma. While the injury does not generally require surgical intervention, it is common for athletes with subungual hematoma to have a physician or athletic trainer perform trephination procedures in an attempt to alleviate pressure buildup beneath the toenail. Subungual hematoma can greatly affect one's athletic performance or even inhibit one from staying active while playing altogether, as it is an extremely painful injury due to tissue damage and intense buildup of pressure under the nail.

Sesamoiditis is another common foot ailment that can be caused from forefoot limiting shoes. The sesamoids are two small bones about the size of jelly beans located in each foot between the first metatarsal bone and the phalanx of the big toe. The sesamoids act as the fulcrum in the foot's important pulley system, assisting the flexor tendons in the flexion of the big toe as well as augmenting the tendons' ability to bear weight (see FIG. 3). Sesamoiditis is defined as the inflammation of the sesamoid bones. Sesamoiditis is most commonly caused by either repetitive and/or exhaustive stress placement on the sesamoid bones during plantar flexion. "Jamming" of the phalanx and first metatarsal bone caused, for example, by repeated sudden impact of the hallux against the toebox of a shoe, may also incite Sesamoiditis. Sesamoiditis is a common form of tendonitis that is very aggravating, not only because of the pain experienced, but also because it is not easily cured.

Hammertoe or mallet toe are deformities to the toes that are caused by tight fitting shoes in the toebox region, or by shoes with raised heels. Such deformities are particularly of concern to athletes who choose to wear tight fitting shoes to minimize slippage or sliding of the foot within the shoe when stopping, cutting or changing direction during an athletic maneuver. Hammertoe or mallet toe can be characterized as the shortening and stiffening of the toe's tendons, fixating them in an upward bend at the middle joint of the toe, followed by a downward bend at the head of the toe (see FIG. 4). This results in a toe orientation that resembles that of a hammer-like or claw-like curled shape. Hammertoe can inflict painful corns or calluses simply by wearing shoes since the unnatural bending of the toes may rub or jam against the shoe. As time progresses, the toes will eventually become permanently fixed in the "hammertoe" curled position, at which point surgical intervention may be needed in order to alleviate pain, restore proper flexibility, and appease aesthetic appearance.

Ingrown toenails may be induced by a countless number of things, but improper nail trimming and ill-fitting shoes are the most common causes. An ingrown toenail is the encroachment growth along the side or edge of the toenail into the surrounding soft tissue or skin of the toe (see FIG. 5). This injury is caused when extra pressure is placed on the toe which is most frequently exacerbated by poorly fitting shoes. Ingrown toenails are indicated by pain, swelling, redness and infection.

The foot and toe injuries outlined above are often caused and intensified by forefoot/hallux limiting, tight fitting shoes. The present invention addresses such foot injuries by providing a more strategic toebox construction that disperses peak pressure placement on the foot/hallux for reducing toe jamming forces that contribute to such injuries.

A number of techniques and devices have been tried in the past to address the prevention, minimization or treatment of the above injuries associated with athletic shoes. One technique has been to simply tape toes together in an effort to distribute the impact forces from the toebox so that a single toe (e.g., the hallux or big toe) does not receive the entire impact force. Other approaches for treating those already affected with turf toe injuries include the use of inserts such as insole inserts for insertion within or as a part of the athletic shoe (U.S. Patent Publication 2012/0240431) and toe brace/splint structures (U.S. Patent Publication 2006/0226737) for immobilizing or restricting movement of the MPJ to reduce pain during rehabilitation. Such devices address post-injury conditions, but do not address reduction or elimination of the causes of turf toe injuries.

A number of athletic shoe innovations have been directed toward restricting forward movement of the foot within the shoe. Some of such innovations have been directed to lacing arrangements and the use of stabilizing members such as reinforcing strips for limiting foot movement. U.S. Pat. No. 3,138,880 is an example of such an arrangement wherein each lacing eyelet ring is connected to a narrow reinforcing strip that extends down the side of the shoe to the margin of the upper. U.S. Pat. No. 4,255,876 discloses an athletic shoe that uses a limited number of reinforcing strips that are not directly associated with each of the lacing eyes. This patent discloses a single reinforcing member surrounding the tongue opening of the upper in zigzag fashion with lacing holes formed therein in like fashion so that alternating pairs of wide set and narrow set holes are disposed along the tongue length. U.S. Pat. Nos. 4,413,431 and 4,813,158 describe yet other variations of lacing eyelets containing reinforcement portions and medial and lateral reinforcement portions. Such innovations reduce, but do not prevent movement of the foot toward the toebox of the shoe.

Another approach that departs from conventional athletic shoe design is a configuration referred to as a "minimalist shoe" configuration. Such shoes have gained popularity in the cross-training and running sports. Minimalist shoes do not employ the traditional toebox portion of an athletic shoe, but are configured as slim outlines of the foot itself, with individual receptor slots for each of the toes. These shoes purportedly provide the wearer with the closest footwear option to that of wearing no shoes at all. The popularity surrounding minimalist shoes is largely due to the fact that they capitalize on delivering shoes that offer a desired barefoot sensation and are lightweight. Vibram S.p.A. markets minimalist shoes (FIG. 6) under its FiveFingers™ brand and claims that such shoes influence runners into a more natural running gait, thereby lowering the impact forces on one's body. However, recent studies have concluded that such shoes are not biomechanically fit for everyone and have found that half of the test subjects did not adjust their running form when making the switch to minimalist shoes and as a result, experienced high impact forces that were nearly twice as high as those that would occur when wearing athletic shoes of traditional design.[1]

Parker-Pope, Tura. "Are Barefoot Shoes Really Better?" *The New York Times*. NY Times.com. 30 Sep. 2011. Web.

One practice or method that athletic shoe wearers have utilized as an injury prevention measure and as a mechanism to improve the comfort of the more conventionally configured athletic shoes is to personally alter the toebox by making a cut through the toebox material in the vicinity of the big toe, usually in the shape of an "X". Cutting of the toebox provides more room for the big toe, and enables the big toe to move forward into the cut region through and beyond the front face of the toebox, reducing toe jamming and lowering the pressure placed on the foot and toe joints when running, jumping or cutting to change directions. Athletes employing such technique claim to like the open, breathable feel that such cuts provide. Some such practitioners also contend that the cuts make their shoes feel lighter and mimic the feeling of running barefoot. Such personal altering of the toebox has been especially prevalent in the sport of football. While making such personal alteration cuts to the toebox of manufactured athletic shoes may in fact improve the comfortability and toe jamming relief of the shoe, no covering material has been incorporated over the cuts, leaving the toes and interior of the shoe directly exposed to the external environment. Accordingly, undesirable objects such as rocks, sand, dirt, grass, field turf beads, and other miscellaneous foreign objects and debris are able to loosely infiltrate the shoe, causing discomfort and even injury to the wearer. Other problems associated with shoes having self-made cuts formed therein is that the hand made cuts are not necessarily optimally placed for alignment with the big toe as it moves within the shoe, and there are no control mechanisms provided to reclose the cut opening when the foot slides back toward the rear of the shoe or to prevent the cuts from increasing in size and growing too large leading to premature breakdown of the toebox and reduction of the integrity of the toebox.

Besides injury prevention and performance, comfort is an important priority for shoe producers and consumers. There have been a plethora of technologies and choice materials used in the design and creation of more comfortable shoes; however, there is always room for improvement in the comfort of athletic shoes. One such way of enhancing comfortability of an athletic shoe is through a significant ventilation system that aids in the breathability of the shoe. The materials selected for the body of the shoe often comprise lightweight wafer or mesh-like breathable fabric that allows for a certain degree of air circulation. In general, however, the toebox portion of athletic shoes, and particularly those with restrictive tight fitting toeboxes have not been particularly susceptible to designs for improving ventilation within the toebox. This has particularly been true for athletic shoes used in contact sports such as football. Those techniques that have addressed the ventilation comfort issue have revolved primarily around changes made to the upper material, or to contour adjustments made to the toebox.

There are some athletic shoes on the market that employ lightweight mesh-like material in the toebox area that promotes ventilation. One such biking shoe is the SHR-300 Road Cycling Shoe sold by Shimano, Inc., that has two breathable mesh cutouts on either side of the toebox for ventilation purposes (see FIG. 7). The mesh, however, does not possess any unique stretchability properties that allows for any expansion of the toebox, and such shoe can only be practically used for biking purposes due to its pedal cleats and hard exterior shape which do not readily allow such shoe to be used for recreational use or casual wear.

The present invention addresses the deficiencies and shortcomings associated with prior known athletic shoe design techniques for minimizing and reducing possible foot and toe injuries associated with impact forces and pressures applied through the shoe toebox to the toes and feet of the person wearing the shoes.

SUMMARY OF THE INVENTION

The present invention provides an improved athletic shoe configuration applicable to many sports, both court and field types of sports. The invention provides a shoe design that significantly reduces delivery of impact forces applied to the foot and particularly those applied to and through the big toe caused by abrupt stopping, jumping or cutting maneuvers performed by the wearer. Such actions have in the past often caused the foot to abruptly slide forward in a shoe, jamming the big toe against the shoe's toebox and imparting large impact forces back through the big toe to its metatarsophalangeal joint, causing injury thereto.

The present invention provides a simple yet effective mechanism for eliminating or at least significantly reducing such jamming impact and injury to the big toe during an abrupt shifting of the foot in the shoe, by providing the toebox with an area of relief for the big toe when it moves forward within the shoe in a manner so as to forcibly engage the forward and/or upper inside surfaces of the toebox. The invention provides such big toe engagement area with a configuration that gently slows the forward advancement of the big toe and allows the toe to advance through and beyond the initial outer peripheral surface shape of the toebox. The invention provides for a toebox design having material of significantly higher elasticity in that area of big toe engagement with the toebox, as compared to the elasticity of the material forming the remainder of the toebox. The toebox may be provided with a cutout of varied configurations through the big toe engagement area thereof, through which the forward part of the big toe can gradually pass instead of jamming hard against the inner surface of the toebox. The cutout portion can be operable to normally function in a semi-closed configuration during routine use of the shoe, wherein the cutout portion material essentially closes the passageway through the toebox to protect the toes in traditional toebox fashion. However, upon abrupt forward sliding of the foot within the shoe, the big toe moves forward to engage the movable member(s) across or forming the cutout, or other area of relief, which readily push outward to form an enlarged passageway through which at least the front portion of the big toe can pass, without sustaining a large potentially injury causing impact force. When the foot slides back to its original position within the shoe, the big toe withdraws from the cutout, which resumes its initial or at-rest closed or semi-closed configuration. The position of the cutout in the toebox is strategically located to align with the actual area of big toe engagement with the toebox as the foot and big toe slide forward within the shoe.

The center of such toe engagement area, which also generally coincides with the center of the cutout, lies along a forefront portion of the toebox that intersects a generally vertical plane containing a longitudinal axis passing through the phalanges bones of the big toe (the longitudinal toe axis). Since the nail portion of a big toe may represent the foremost portion of a vertically unsymmetrical big toe, and is located above the longitudinal toe axis passing through the phalanges bones, the actual center portion of the cutout will generally lie slightly above the intersection of the longitudinal toe axis with the toebox, at a vertical position more toward the nail of the toe. Further, the forward inside sole portion of many athletic shoe configurations is upwardly inclined adjacent the forepart of the toebox which tends to bend the big toe upward, lifting its front surface and nail as the toe advances forwardly in the toebox. In such shoe configurations the center of the toebox cutout may be positioned even further above the initial contact area of the big toe's nail with the toebox to account for the continued rise of the big toe as it proceeds forwardly into the cutout passageway. In such instances, the center of the cutout may be positioned more toward the top surface of the toebox than through the front surface thereof.

The invention comprises a stretchable layer or web member secured to the toebox in a manner so as to lie across the cutout portion of the toebox. The stretchable layer or web may form a relatively smooth outer surface of the toebox, and inhibits sand, dirt and other foreign matter and debris from entering the toebox through the cutout. The stretchable layer or web may for example, be attached to the outer or inner portions of the toebox or in interleaved manner to the less stretchable material forming the toebox. The stretchable layer could also comprise an inner liner material of the shoe. Besides being stretchable, the web member is also preferably porous to air, to provide direct ventilation to the toebox enclosure. The stretchable layer or web material has sufficient elasticity to accommodate movement of the big toe through the cutout and to allow it to project forwardly past the forward outer peripheral wall of less stretchable material forming the toebox. As the big toe engages the stretchable layer and progresses through the cutout passageway, its forward motion is gradually slowed to a stop rather than being abruptly stopped by a toebox having a continuously solid or front surface of low stretchability. The stretchable web material not only receives the forward end of the big toe, but also cooperates with any pivotally movable portions of the cutout as they open to define a larger passageway for the advancing big toe, and is constructed of a highly elastive material that does not significantly restrict movement of any cutout portions as urged forward by the advancing big toe. When the big toe is withdrawn from the cutout passageway, the stretchable web material retracts to its original unstretched configuration, and in the process of retracting to its original position assists in returning any of the pivotally movable portions of the cutout to the their closed or semi-closed positions, thereby restoring the initial generally smooth protective outer peripheral surface of the toebox.

Therefore, according to one aspect of the invention, there is provided an athletic shoe sized, arranged and configured to operatively house a foot of a wearer of the shoe, comprising:

a. a sole;

b. an upper operatively connected to the sole and including a toebox portion operatively configured to contain the toes of the foot and defining an initial outer peripheral forepart surface, said toebox portion comprising: a first forepart portion of a first material and a second forepart portion of a second material having stretchability significantly higher than that of said first material, said second portion being arranged and configured to be engaged by a selected advancing toe of the foot as the foot moves forward within the shoe; and;

c. wherein the stretchability of the second material is sufficiently large to enable the engaged advancing toe to stretch the second material sufficiently to allow at least a portion of the advancing toe to forwardly project beyond the initial outer peripheral forepart surface of the toebox while applying a resistive damping force to the engaged advancing toe, for slowing movement of the toe.

According to another aspect of the invention, the selected advancing toe is the big toe of the foot. According to yet a further aspect of the invention, the second forepart portion of the toebox is arranged and configured to be engaged by an advancing big toe at a point of actual impact of the big toe with the toebox. According to yet another aspect of the invention, the second material of the second portion of the toebox is capable of multi-directional stretching and can be sufficiently stretchable to enable projection of at least a portion of the advancing toe beyond the initial outer peripheral forepart surface of the toebox by any distance of up to about 1.0 inches. According to yet a further aspect of the invention, the second material retracts to its initial configuration that it had before stretching by the advancing toe, when the toe moves back out of engagement with the second material, thus reestablishing the initial outer peripheral forepart surface configuration of the toebox. According to yet a further aspect of the invention, the toebox first forepart portion defines an opening therethrough which is operatively aligned with a point of actual impact of the selected advancing toe with the toebox, and is sized and configured to cooperatively receive the advancing toe, and wherein the second material of the second forepart portion is operatively connected to the first forepart portion of the toebox and is arranged to extend across the opening through the first forepart of the toebox.

According to yet a further aspect of the invention, there is provided an athletic shoe, sized, arranged and configured to operatively house a person's foot, comprising:

a. a sole;

b. an upper operatively connected to the sole to form a shoe for a human foot, wherein the upper has a forward toebox portion housing the toes of the foot and has a point of actual impact for an advancing big toe of the foot when the foot abruptly moves within the shoe; the toebox having a cutout forming a passageway therethrough having a center generally aligned with the point of actual impact, and wherein the passageway is sized and configured to receive and enable at least a forward part of the advancing big toe to move into and through the passageway and beyond an outer peripheral surface of the toebox; and c. a stretchable layer operatively connected to the toebox and extending across the cutout passageway, having elasticity sufficient to enable the advancing big toe to move into and through the passageway against the bias of the stretchable layer.

According to yet a further aspect of the invention, the stretchable layer is secured to an inner surface of the toebox portion and can be secured to the toebox portion by stitching. According to yet a further aspect of the invention, the stretchable layer comprises porous material of a type suitable for providing ventilation to the inside of the toebox through the cutout passageway while blocking entry of particulate debris and foreign matter into the toebox through the cutout passageway. According to yet a further aspect of the invention, the cutout comprises a plurality of intersecting cuts through the toebox which may contain toebox material between adjacent ones of the intersecting cuts that are pivotally movable to define or enlarge the passageway in response to advancing movement of the big toe. According to yet a further aspect of the invention, the stretchable layer retracts to its initial configuration, urging any moveable portions of the cutout back toward their initial positions when the big toe moves back out of engagement with the cutout. According to yet a further aspect of the invention, the cutout can comprise at least in part a hole passing through the toebox portion. According to yet a further aspect of the invention, the stretchable layer comprises at least in part, elastive fibers, wherein the elastive fibers preferably comprise about 3% to 50% of the web material. According to yet another aspect of the invention the stretchable layer may comprise a combination of elastive fibers and condensation polymer material, and is capable of multi-directional stretching. According to yet a further aspect of the invention, condensation polymer materials may comprise nylon, polyesters, polycarbonates or thin neoprene. According to yet a further aspect of the invention, the combination of the toebox cutout and associated stretchable layer enable projection of at least a portion of the advancing big toe beyond the outer peripheral surface of the toebox by any distance of up to about 1.0 inch. According to yet a further aspect of the invention, the cutout passageway and stretchability of the web are such that a forward part of the big toe when moving through the passageway under forward pressure can move beyond the forward surface of the toebox material by at least a distance of about ⅛ inch, more preferably by a distance of at least about ¼ inch, still more preferably by a distance of at least about ½ inch, and even by a total distance of 1 inch or more.

According to yet a further aspect of the invention there is provided an athletic shoe of a type arranged and configured for use in an athletic sport and proportionately arranged, sized and configured to receive a human foot, comprising:

An athletic shoe of a type arranged and configured for use in an athletic sport and proportionately arranged, sized and configured to receive a human foot, comprising:

a. a sole extending along the bottom portion of the shoe;

b. an upper, operatively connected to the sole, the upper including a toebox at a forward end thereof configured to operatively enclose the toes of the foot, including a big toe thereof; wherein the toebox has at least a forward portion thereof constructed of a material having generally uniform properties across the forward portion;

c. said toebox defining a cutout portion formed through at least the forward portion of the toebox; wherein the cutout portion is generally aligned with the big toe of said foot so as to be generally centrally engaged by the forward end of the big toe when the big toe abruptly moves is a forward direction within the shoe; said cutout portion being configured to define an opening through the toebox material sized to allow passage of at least the forward portion of the toe therethrough to an extent such that the forward toe portion extends through and forward of the outer front peripheral surface of the toebox; and d. a cover of stretchable material secured to the toebox so as to cover at least a maximum peripheral opening extent of the cutout, and having an elasticity sufficient to enable the big toe to advance into and through the cutout opening while imparting damping resistance to the advancing toe; said elasticity of the stretchable material being significantly higher than that of the toebox forward portion.

According to yet a further aspect of the invention, an outer surface of the stretchable cover material may include indicia comprising one or more of: lettering, graphics or colors. According to yet a further aspect of the invention, the cutout portion includes segments of the toebox material that pivotally move outwardly against the bias of the stretchable cover material when engaged by the big toe advancing in a forward direction, to enlarge the size of the cutout opening as the big toe advances. According to yet a further aspect of the invention, an inner directed surface of the stretchable cover offers minimal sliding friction to the pivotally moving segments of said cutout as they move to enlarge the size of the cutout opening. According to yet a further aspect of the invention, the cover of stretchable material is preferably secured to the toebox section before the upper shoe portion is secured to the sole.

According to yet a further aspect of the invention, there is provided a shoe arranged, sized and configured as an athletic shoe, to accommodate a human foot, comprising:

a. a sole;

b. an upper operatively connected to the sole and forming therewith an internal cavity sized and configured to accommodate a foot, comprising: a heel portion disposed at a rear portion of the upper; a toebox disposed at a forward portion of the upper; and a midsection connecting the heel and toebox portions and defining a centrally located elongate opening disposed rearwardly of the toebox and opening into the internal cavity;

c. said toebox defining an interior space for accommodating the phalange portions of the foot; and further comprising a cutout portion defining a passageway through a forward portion of the toebox and having a center coinciding with a point of actual impact of a big toe of the foot with the toebox portion when the foot abruptly slides forward in the shoe, wherein the cutout center lies in a generally vertical plane containing a longitudinal toe axis centrally passing through the big toe phalanges bones of the foot when functionally positioned within the shoe; said cutout passageway being sized and configured to receive and allow at least a front portion of the big toe to pass through and beyond an outer peripheral surface of the toebox; and d. a layer of stretchable material operatively connected to the toebox to extend across the cutout portion and having elasticity sufficient to significantly stretch in response to movement of the big toe moving in a forward direction through the cutout portion.

According to yet a further aspect of the invention, the sole of the shoe has an outsole, and wherein the outsole comprises cleats downwardly depending from a general plane of the outsole, and further wherein such cleated shoe is arranged and configured as a football shoe. According to yet another aspect of the invention, the shoe further comprises:

a. a tongue operatively connected to the upper and extending across the elongate opening; and b. a fastener connected to tighten the upper midsection over said tongue and across the elongate opening.

According to yet a further aspect of the invention, the toebox comprises a material having little or no stretchability. According to yet a further aspect of the invention, the layer of stretchable material comprises at least in part elastive fibers and is capable of multi-directional stretching. These and other aspects of the invention will become more apparent from a reading of the following detailed description of a preferred embodiment of the invention.

BRIEF DESCRIPTION OF THE DRAWING

Referring to the Drawing, wherein like numerals represent like parts throughout the several views.

DETAILED DESCRIPTION OF THE PREFERRED EMBODIMENT

Figure 1:
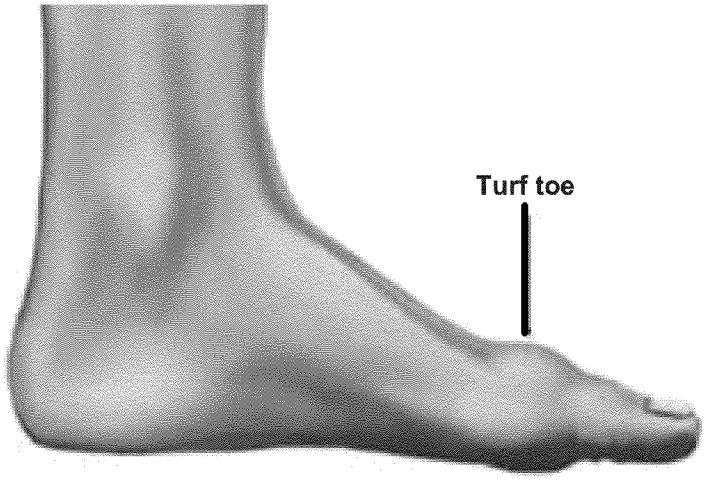
FIG. 1 is a pictorial view in side elevation of a foot having a turf toe injury.
Figure 2:
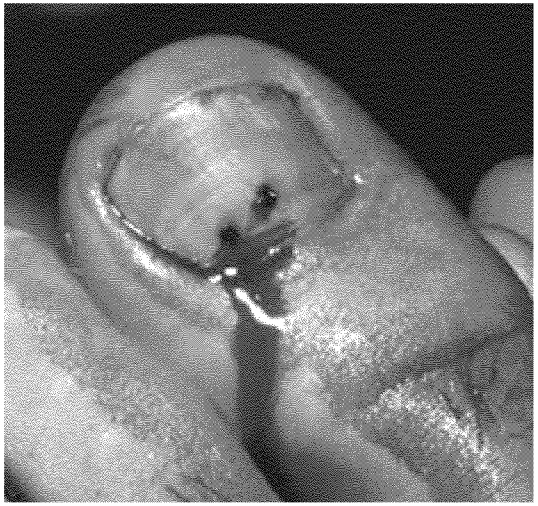
FIG. 2 is a pictorial top view of a toe that has been subjected to subungual hematoma injury.
Figure 3:
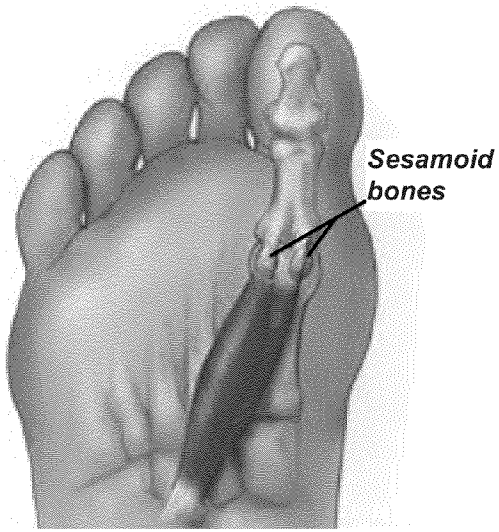
FIG. 3 is a pictorial diagrammatic representation of the bottom of a foot, illustrating the sesamoid bones and the location of a sesamoditis injury on the foot.
Figure 4:
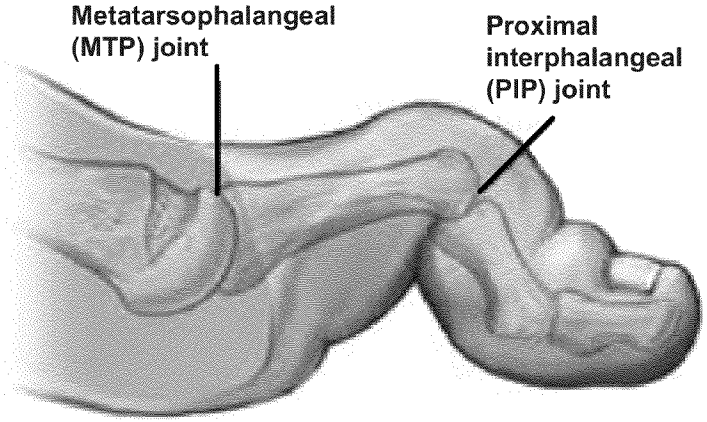
FIG. 4 is a diagrammatic representation in side view of a toe with a hammer toe deformity.
Figure 5:
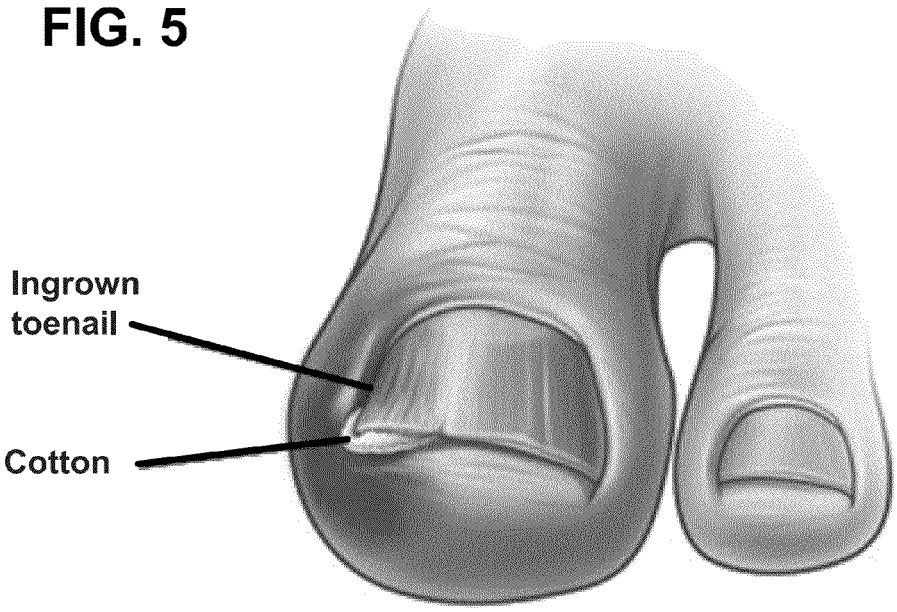
FIG. 5 is a pictorial representation in top front view of a big toe having an ingrown toenail.
Figure 6:
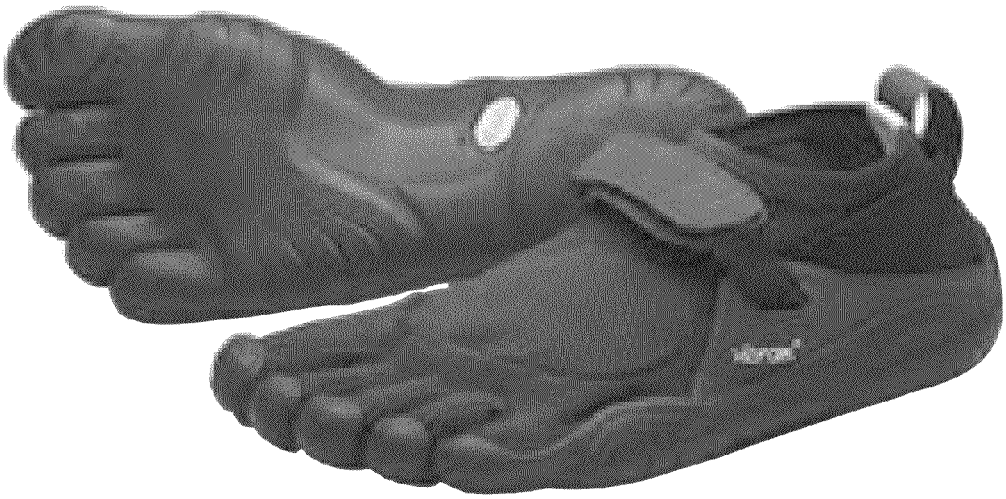
FIG. 6 is a pictorial representation illustrating a pair of FiveFinger™ shoes sold by Vibram S.p.A.
Figure 7:
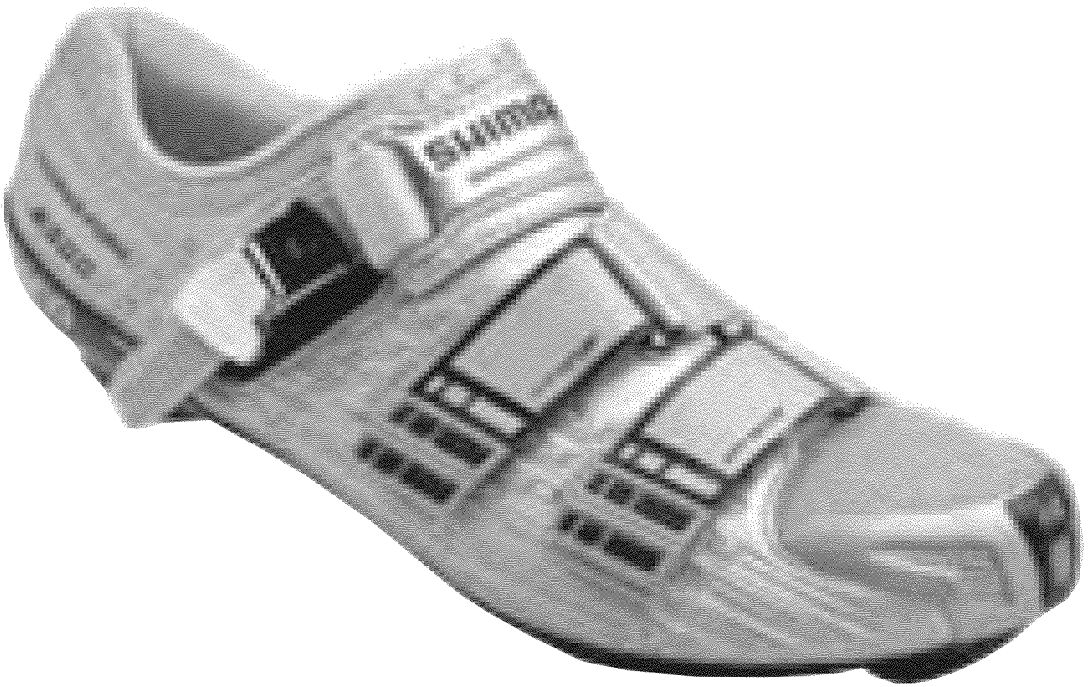
FIG. 7 is a pictorial representation of an SHR-300 Road Cycling Shoe sold by Shimano, Inc.

An athletic shoe practicing the principles of this invention may be of any general construction and of materials both currently known and yet to be developed, that are suitable for use with the particular sport for which the shoe will be used. For example, a shoe used for football would have materials and construction details differing from one designed for use as a tennis shoe or a basketball shoe or a running shoe. All of such athletic shoes, regardless of the sport with which they will be used, generally have similar functional sections such as: a sole portion, an upper or vamp portion connected to and extending upwardly from the sole, a back or heel counter portion and a toebox portion oppositely disposed from the heel counter portion at the front end of the shoe. Such athletic shoes may have a tongue portion extending back from the toebox toward the foot entry portion of the shoe and connecting the upper oppositely disposed lateral and medial portions of the vamp. Such athletic shoes also may have a pair of eye stays disposed along the top portion of the vamp on opposite sides of the lateral edges of the tongue for accepting laces to tighten the shoe on a user's foot, or other appropriate closure means such as fastener straps or buckles, such as for example shown in the FIG. 7 shoe manufactured by Shimano, Inc. Current athletic shoes typically have one or more layers of midsole cushioning secured to and disposed above the sole for providing support and cushioning to the bottom of a person's foot. The bottom of the sole, typically referred to as the outsole may contain cleats or ribs or be generally flat with a unique gripping pattern of recesses suitable for engaging the particular surface for the athletic sport with which the shoe will be used. The athletic shoe may also have an insole and may include some type of internal lining and/or padding material for receiving and engaging the wearer's foot and for preventing direct engagement of the foot with the inside surfaces of the more rigid or abrasive portions of the shoe forming the outer shell portions thereof.

The forward portion of the athletic shoe upper that overlies the sole and midsole is typically referred to as the toebox and when attached to the sole/midsole, is configured to encircle and contain the toes of the wearer's foot. This invention is directed to the construction of the toebox portion of an athletic shoe, which otherwise can be of generally any appropriate configuration and construction known in the art, or yet to be invented, and uniquely configured for use with that sport with which it is associated.

The invention is not limited to a shoe for any specific sport or sports, but the above examples of court and field activities such as recreational walking or running, cross-training, football, soccer, basketball, lacrosse, rugby, tennis, volleyball, cross-country running, racquetball, squash, handball and track represent the typical sports to which the athletic shoe of the present invention could apply. It will be understood by those skilled in the art, that the invention is not to be limited to the above delineated sports, but applies to shoes associated with all sports wherein the shoe has a toebox for housing the wearer's toes, and wherein the shoe can subject the wearer's toes to pressure and impact forces from engagement with the toebox as a result of foot movement within the shoe.

Similarly, other than as specified herein, the invention is not limited to any particular materials or processes used to construct the shoe. The shoe could, for example, be constructed of rubber, leather, synthetic materials, composites, fabrics (woven or unwoven), polymers and plastics, foams, gels or combinations or hybrid configurations thereof Generally, however, the toebox portion of the shoe without the present invention would be configured from materials that are generally considered to be non-stretchable or having very limited or uniform stretch capability. This invention provides for a selected region of stretchable material forming a portion of the toebox, as hereinafter described in more detail.

As is the case for the use of various materials for constructing the athletic shoe, except as otherwise recited in the claims hereof, the invention is not limited to any particular method of manufacturing or constructing the shoe. By way of example only, the shoe could be manufactured by a cold cement process, by a vulcanization process or by direct injection. Generally, the processes used to manufacture an athletic shoe depend on the materials used, on cost factors and on the particular end use market for the shoe.

The toebox portion of a shoe configured according to this invention is designed and configured to allow upon forcible impact of a toe with the toebox, movement of at least one toe beyond the otherwise forward boundary position defined by the material forming the forward portion of the toebox. Since the hallux or big toe is the toe primarily subjected to injury when the foot abruptly slides within an athletic shoe, a preferred embodiment of the invention described herein will be directed to its applicability in reducing injury to the big toe. It will be understood by those skilled in the art that the invention can be selectively applied equally well to the protection of toes other than the big toe. According to one embodiment of the invention, a select portion of the toebox of the shoe is designed and configured to provide an area of increased stretchability and low initial resistance to forward advancement of the big toe after it engages the forepart of the toebox. Such rapid forward movement of the foot and big toe may occur when the foot slides forward in the shoe as a result of an abrupt stop or cutting action taken by the wearer—wherein the shoe abruptly stops moving in the forward direction, but the foot's forward momentum continues to advance the foot within the shoe such that the big toe forcibly engages the inner front surface of the toebox. The invention contemplates associating the area of increased toebox stretchability with creation of an opening formed or formable through the forefront toebox material with an elastic layer or web of material secured to the toebox and extending across the opening, to receive and slow forward movement of the toe as it enters and penetrates into the opening. The elastic layer or web can be constructed from porous breathable material to impede infiltration of dirt and debris into the opening while providing ventilation to the toebox, which provides damping forces to the toe as it moves into and through the opening, and which aids in restoring the opening to its original size and configuration when the foot slides back to its normal at rest or initial position in the shoe.

Figure 8:
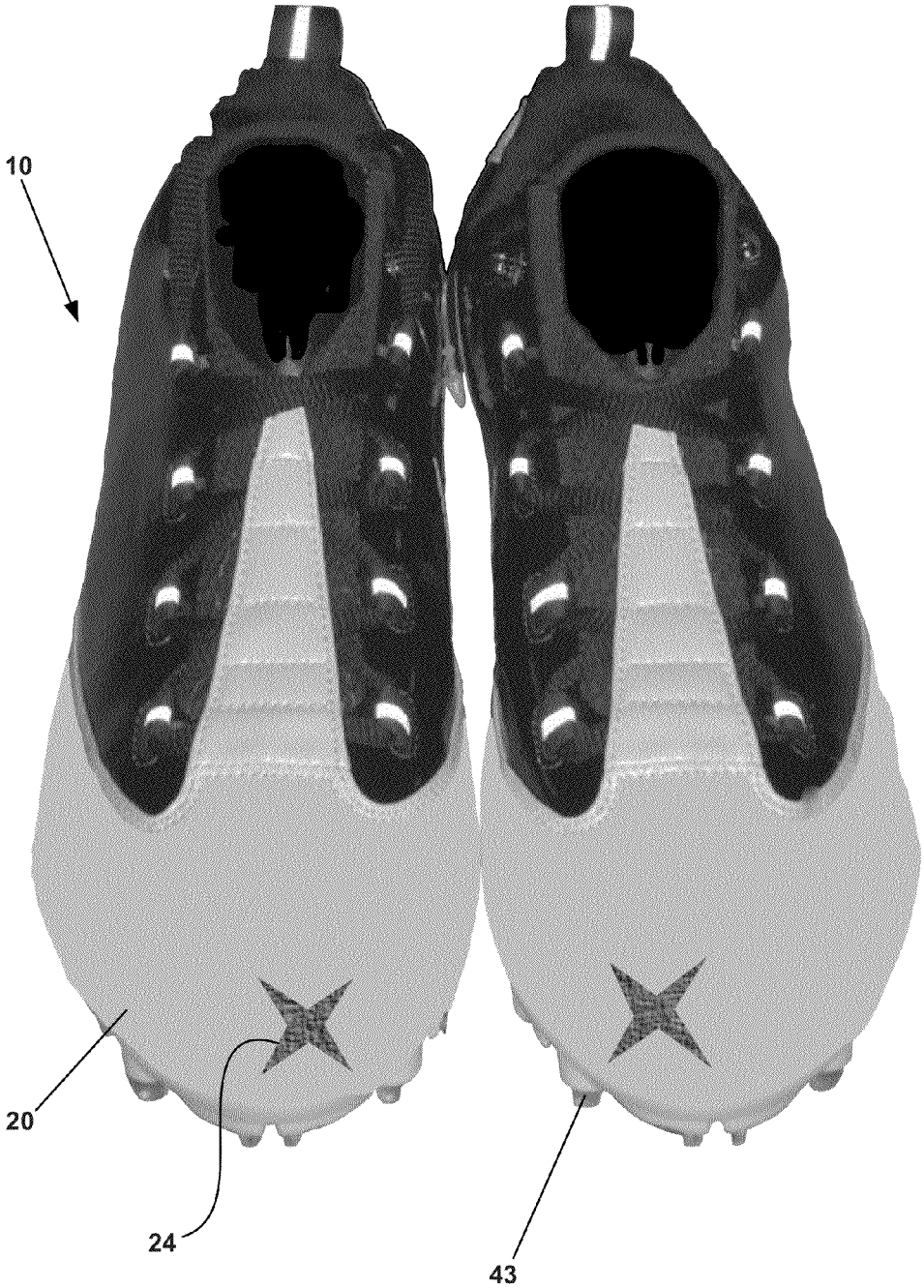
FIG. 8 is a pictorial representation of a pair of football cleat athletic shoes incorporating the principles of this invention.

Referring to FIGS. 8-14, there is generally illustrated therein preferred embodiments of an athletic shoe configured for use as a football cleat that incorporates the principles of this invention. FIG. 8 is a pictorial representation of a matched pair of athletic shoes incorporating the invention. The remaining figures are directed to details of a single one of a matched pair of shoes, it being understood that the other of the matched pair of shoes is configured as a mirror image of the left shoe that is portrayed in FIGS. 9-14. It will be noted that the shoe configuration of FIG. 8 differs slightly from that of FIGS. 9-14, but both configurations incorporate the present invention.

Referring to FIGS. 9-14, an athletic shoe 10 generally configured according to one embodiment of the present invention is illustrated in FIGS. 9-14. The shoe 10 is configured for use in football; however, as previously discussed, the invention is not limited to athletic shoes used in any particular sport. Shoe 10 has an upper or vamp 12 and a sole 14. The upper 12 is joined to the sole 14 along the featherline 13 (i.e., the lower peripheral lasting margin of the upper 12). The vamp extends from a heel counter portion 16, along the outer lateral (12*a*) and inner medial (12*b*) sides of the shoe respectively, and to a toebox 20 at the forefront of the shoe and oppositely disposed from the heel counter portion 16. The vamp 12 defines an elongated throat opening 15. A shoe tongue 17 underlies the forward portion of the elongated throat opening 15 and is secured by stitching or other means along its outer peripheral front and side edges to the vamp. The rearward portion of the elongated throat opening 15 located rearward of the tongue 17 and forward of the heel counter 16 defines a leg opening 15*a* for accommodating the ankle and leg portions of the wearer and for providing access therethrough for receiving the wearer's foot into the internal cavity of the shoe. The toebox 20 is configured to extend over the toes of the wearer of the shoe, and is positioned to extend just forward of the metatarsophalangeal joints (MPJ) of the toes. The upper/vamp portion 12 of the shoe is preferably made of lightweight non-stretchable material and may comprise for example, leather or be of multi-layer or synthetic material construction.

A generally U-shaped lacing hole reinforcing portion 30 is secured to the vamp 12 adjacent to and surrounding the forward portion of the throat opening 15 and is provided with a plurality of pairs of lacing holes 31, with the holes of each pair of holes being located on opposite sides of the throat opening. An elongate lace 32 is entrained through the lacing holes 31 in well-known manner, to secure the shoe to the foot of the wearer. Although lacing holes and a lace 32 are disclosed as being used for tightening the shoe about the foot, it will be understood that other known closure systems for securing the opposing sides of the throat opening to one another could be used, including for example, such fasteners as strap members having fasteners such as hook and loop Velcro fasteners or other securing mechanisms such as buckle type fasteners. The shoe 10 typically includes additional reinforcement portions for addressing various foot support functions, known in the art. Several such additional reinforcement members that are in the preferred embodiment stitched to the underlying vamp portion 12, are shown in the FIGS. 34, 36 and 38. The reinforcement members are generally constructed of strong, durable and non-stretchable materials. The shoe 10 also includes an inner liner and various padding portions of breathable material, generally referred to at 40.

The sole 14 generally includes a lower outsole 42 layer and a midsole 44 layer. Since the preferred embodiment shoe 10 is utilized with the sport of football, the outsole 42 layer has integrally molded cleats 43 downwardly projecting from the general plane of the outsole 42 for providing traction to the grass or turf field on which the shoe will be used. The midsole 44 layer is preferably made of one or more resilient cushioning materials which are not as hard as that of the outsole 42 layer. The midsole 44 layer can be constructed from a number of various materials such as sponge rubber, EVA sponge and may even incorporate channels of pressurized gas or other media suitable for cushioning forces transmitted through the outer sole to the foot of the wearer. An insole (not illustrated) can also be inserted within the shoe to provide added or specialized support for the foot.

Since the present invention applies to numerous types of shoe configurations of varied construction and materials and methods of manufacture known by those skilled in the art, the details of such configurations, constructions, materials and methods of manufacture will not be detailed herein. It will be understood that those skilled in the art could incorporate any number of such designs and materials and configurations thereof and types of construction methods to fabricate athletic shoes of a type suitable for incorporating the present invention. The invention is directed primarily to the toebox portion of the shoe.

While the toebox portions of some athletic shoes include an outer material that has limited stretchability such material is typically located on the top portion of the toebox. The forward portion of most athletic shoe toeboxes are typically constructed of non-stretchable materials and in the case of contact sports such as football, virtually the entire toebox portion is constructed of non-stretchable material that is reinforced or thicker than the material forming the mid-section of the upper. Accordingly, the toebox of conventional athletic shoes in the marketplace do not provide any give or relief to the big toe when it jams against the inner forefront surfaces of the toebox as the foot slides forward in the shoe during an abrupt stopping or change of direction maneuver. Being the largest and the one that typically extends foremost within the toebox, the big toe generally receives the majority of the impact forces imparted by the toebox to the toes during a stop or cutting movement. Accordingly, while the toebox imparted forces can be received by all of the toes, since the big toe is the primary recipient of such force, our further discussion herein will be directed to the big toe. While some shoe configurations have inserted stretchable liners and padding materials inside of the toebox to pad the foot, such materials have no or minimal effect in slowing the movement of or in absorbing the impact forces transmitted to the wearer's big toe when significant and abrupt forward movement of the foot occurs within the shoe. Other shoe configurations such as described in U.S. Pat. No. 4,255,876 configure the entire forward toe section from stretchable material having limited stretchability, but do not provide any selected areas of differential stretchability in or across the toebox for accommodating rapid forward jamming movement of a selected toe or toes as the foot slides forward during abrupt stopping and/or cutting motions of the foot.

Figure 10:
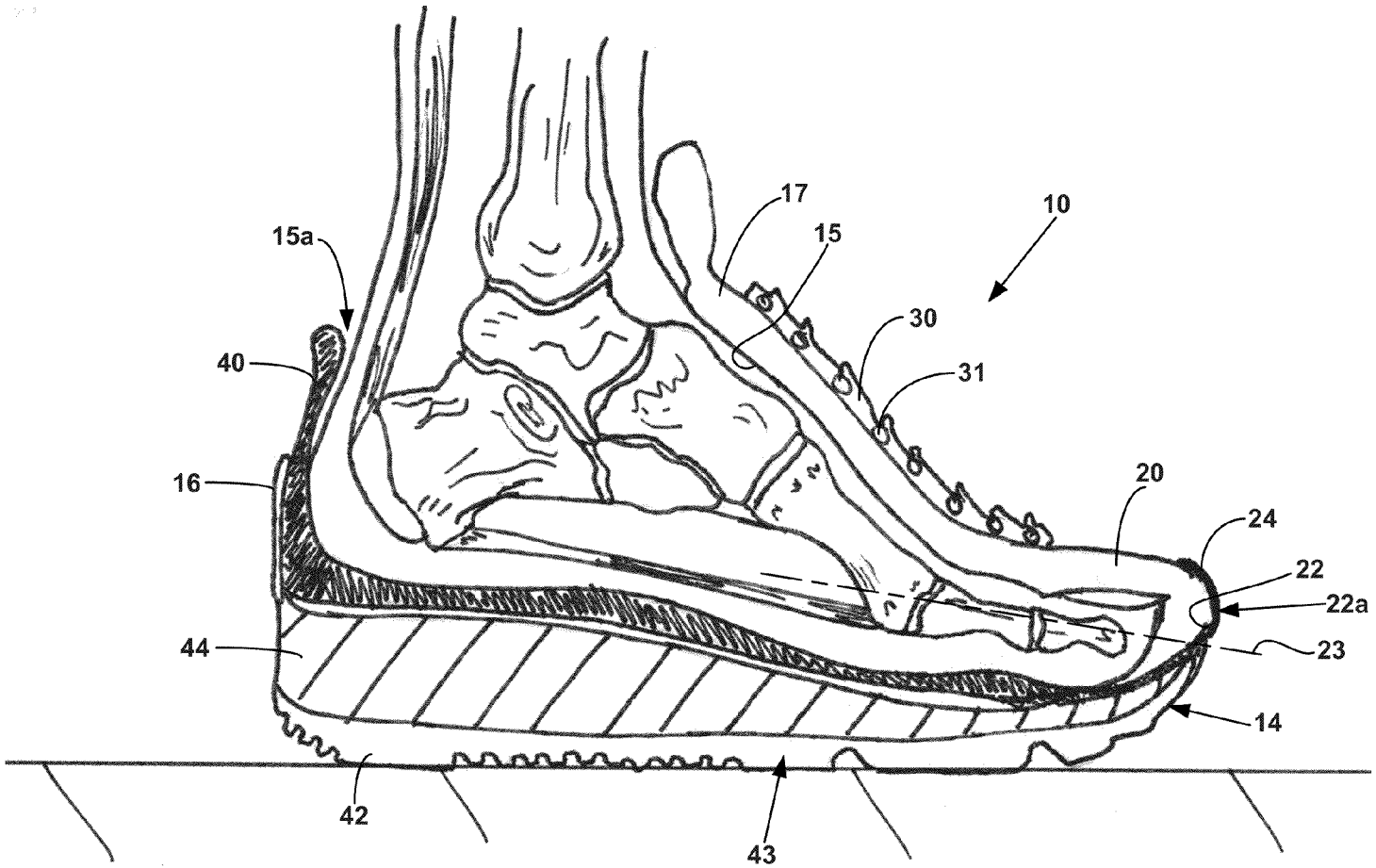
FIG. 10 is a diagrammatic cross-sectional view of the shoe of FIG. 9, generally taken along the Line 10-10 of FIG. 9, illustrating the position a person's foot might assume within the shoe when in a rearward resting position.

The material forming the toebox 20 of the preferred embodiment is generally non-stretchable and of durable construction and thickness for suitably withstanding the scraping, sliding, and other impact forces to which it is subjected in the rugged football contact sport environment. In the preferred embodiment illustrated the toebox 20 has a cutout portion 22 extending through the toebox material at the forefront portion of the toebox. The purpose of the cutout 22 is to selectively provide a low resistance pressure relief zone through the material forming the toebox 20 into which the big toe can progressively move as the wearer's foot forcibly and abruptly moves forward within the shoe. In general, the cutout 22 is positioned along the forefront of the toebox 20 at a position that will be longitudinally engaged by the front of the wearer's big toe as it slides forward and engages the toebox 20. While the shape of the cutout 22 can vary as described below, its configuration will generally define a center portion generally indicated at 22*a*, positioned to lie in the same generally vertical plane containing a longitudinal toe axis 23 (hereinafter defined) extending through that position within the shoe that is designed to hold a big toe of a foot for which the shoe is designed to fit. The longitudinal toe axis 23 generally extends from the MTP joint (MPJ) and centrally through the proximal and distal phalanges bones of the big toe when the phalanges are extended in general longitudinally aligned positions as they would appear for example in FIGS. 10-13. Such aligned phalanges positions can occur both when the big toe is lying generally horizontally as it may occur when the foot is at-rest within the shoe as in FIG. 10, and also when the phalanges are pivoted upwardly around the MTP joint as for example in FIG. 13. As shown in FIG. 10, due to the construction of the sole and midsole portions of the shoe 10, which may be designed to elevate the heel of the foot relative to its toes, the longitudinal axis 23 may not be truly horizontally positioned, but may form a slight acute angle with respect to the general plane of the bottom portion of the outer sole 42 which engages a support surface such as a playing field. The center of the cutout lies along a forefront portion of the toebox that intersects the generally vertical plane that also contains the longitudinal toe axis. The vertical position of the center portion 22*a* of the cutout 22 along that toebox portion intersecting the vertical plane will depend upon the position of actual impact of the front of the big toe with the inside surface of the toebox as the foot and toe slide forward within the shoe 10. For ease of description, such impact area will be referred to as the "point of actual impact."

A number of factors determine the point of actual impact of the big toe with the toebox. Since the toe is not vertically symmetrical, the upper nail of the toe may represent the foremost part of the toe that will first engage the toebox. This may be particularly applicable in toebox shoe configurations wherein the front of the toebox is rounded and/or rapidly tapers back toward the upper. Further, the forward insole portion of the shoe may be configured to slope upwardly as it approaches the front of the toebox, forcing a forwardly advancing toe upward toward the top portion of the toebox. Both conditions contribute to positioning the point of actual impact of the toe with the toebox, and thus the center portion 22*a* of the cutout, at a position along the generally vertical plane that is above the projected intersection of the longitudinal toe axis 23 with the toebox. The actual amount of such offset will depend upon the interior configuration of the front portion of the toebox and on the configuration of the insole portion of the shoe leading to and adjacent the front of the toebox.

Figure 9:
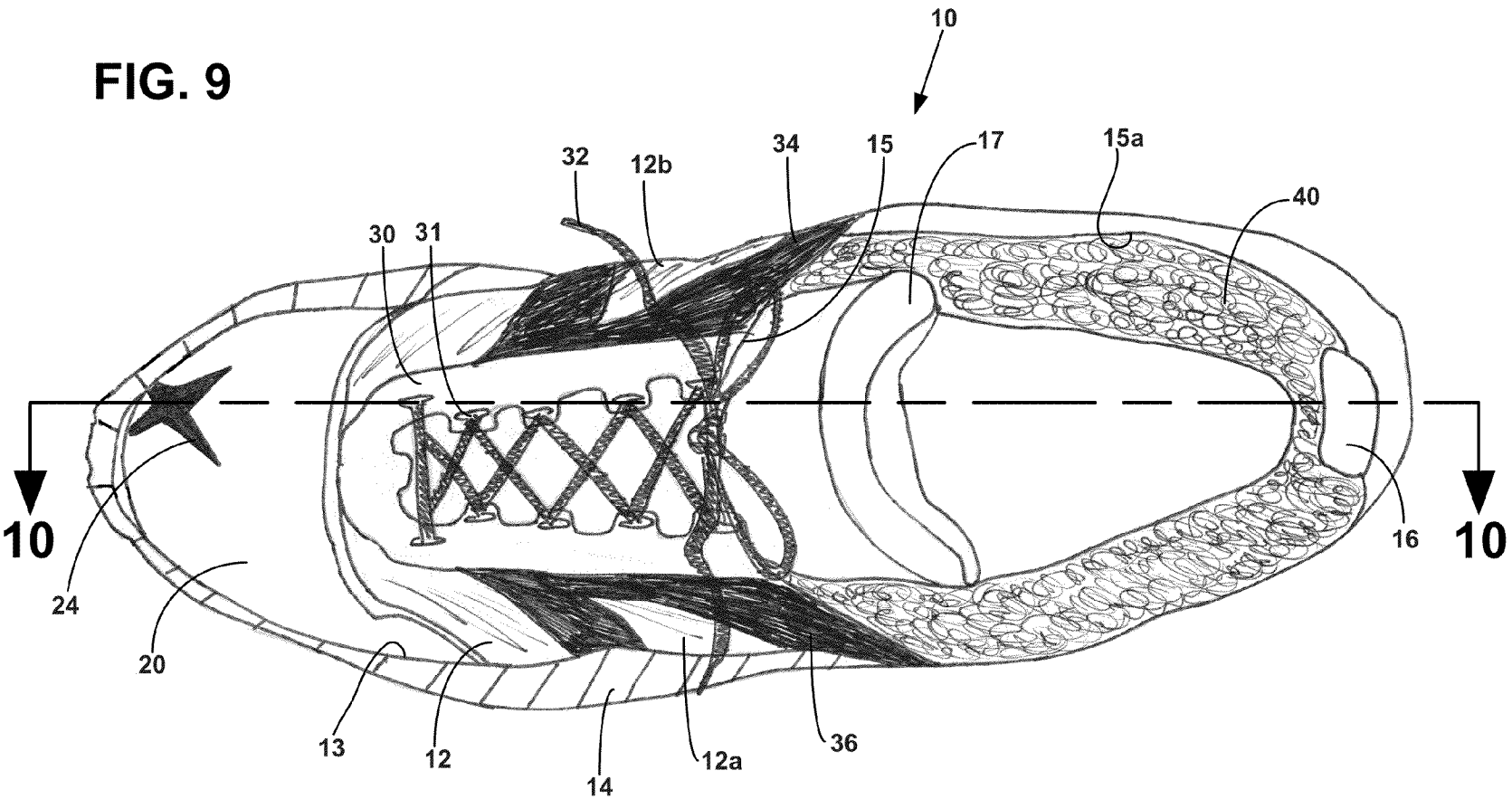
FIG. 9 is a top view of one embodiment of a left foot football cleat athletic shoe incorporating the principles of this invention and illustrating the location of a cutout assembly in the toebox portion of the shoe.
Figure 11:
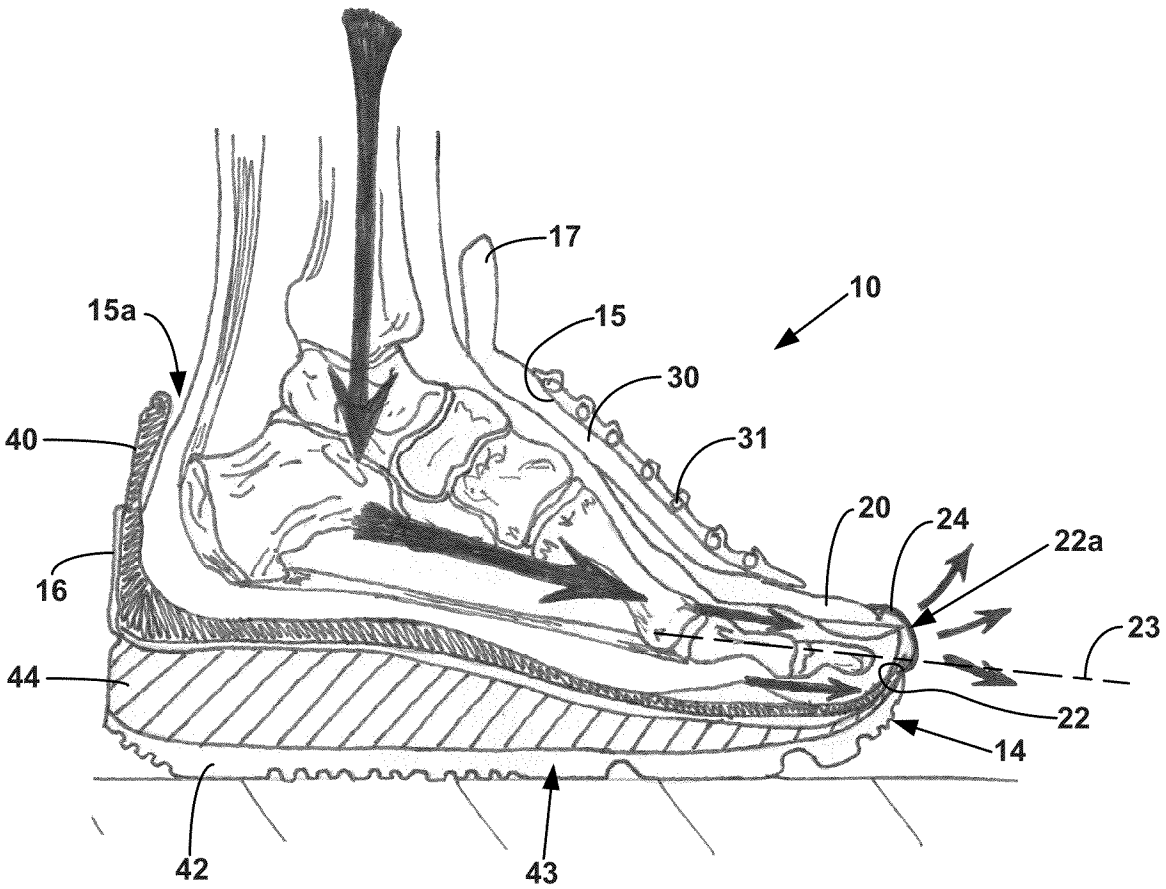
FIG. 11 is a diagrammatic view of the shoe of FIG. 10, illustrating the position a person's foot might assume within the shoe when the foot slides forward within the shoe, when substantially all of the sole of the shoe rests on and fully engages a support surface.
Figure 12:
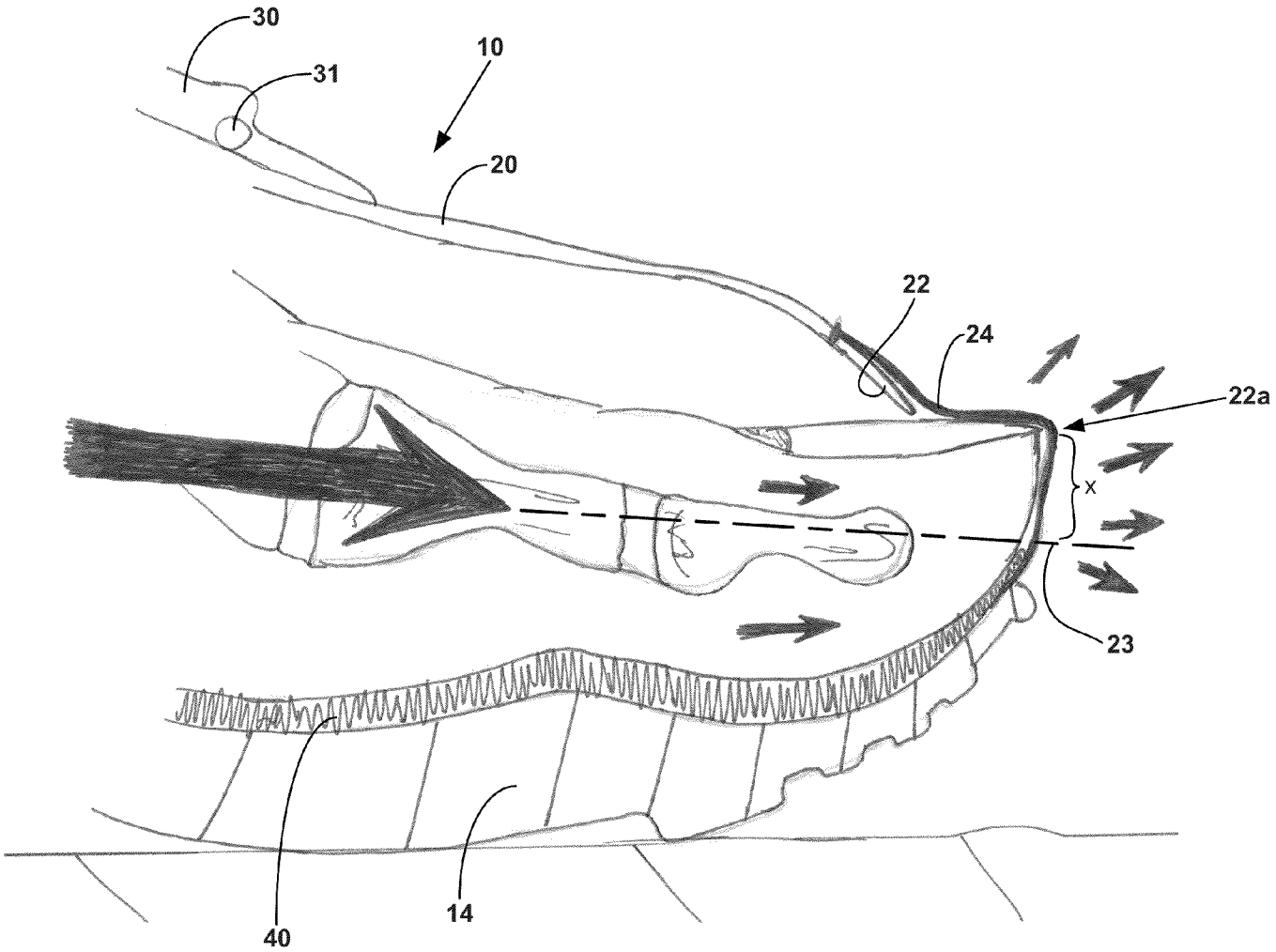
FIG. 12 is an enlarged view of the forward, toebox portion of the shoe of FIG. 11.

FIGS. 10-13 illustrate various positions of a foot within the preferred embodiment shoe 10. FIG. 10 illustrates the foot as it would appear in a rearward or at-rest position within the shoe. As illustrated in FIG. 10, the longitudinal toe axis 23 slightly slopes downwardly due to the sloping wedge shaped configuration of the midsole 44, forming an acute angle between the bottom of the outsole 42 and the longitudinal toe axis 23. However, due to the rounded forward configuration of the insole adjacent the toebox, as the big toe advances, it will be directed upwardly, causing the point of actual impact of the toe and the center portion 22*a* of the cutout 22 to be significantly upwardly offset from the projected FIG. 10 intersection of the longitudinal toe axis 23 with the toebox. FIGS. 11 and 12 illustrate the position of the big toe of the foot when it has moved forward within the shoe 10 following an abrupt stopping of the shoe's movement when fully engaged to a flat support surface. The forward portion of the big toe has moved forward and upward in the toebox, aligning the point of actual impact of the toe with the center portion 22*a* of the cutout, and still offset upwardly from the projected intersection of the longitudinal toe axis 23 with the toebox. The offset is generally indicated by "x" in FIG. 12 From the outside of the shoe, the center 22*a* of the cutout may appear to be oriented more toward the upper part of the toebox than toward the front of the toebox, as illustrated in FIGS. 8 and 9.

Figure 13:
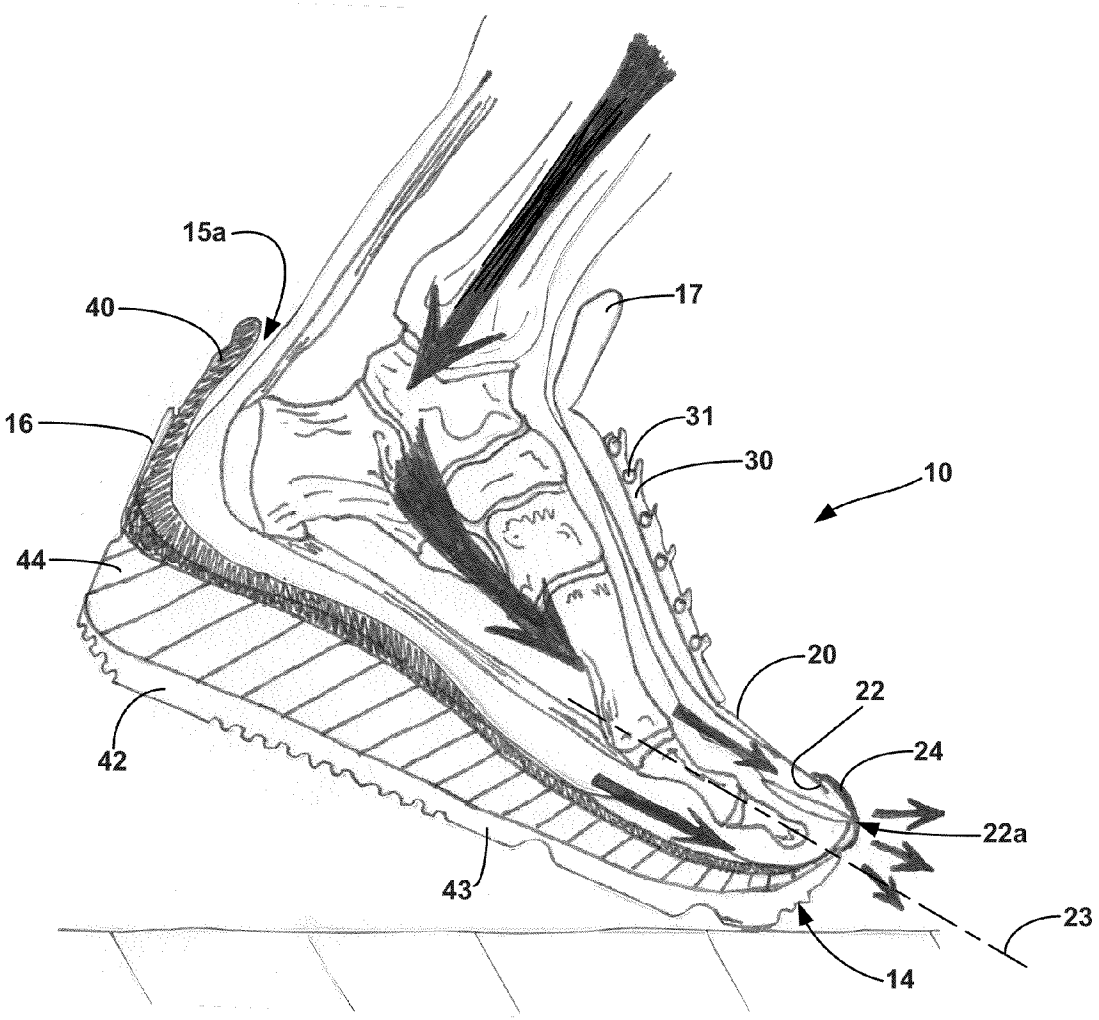
FIG. 13 is a diagrammatic cross-sectional view of the shoe of FIG. 10, illustrating the position a person's foot might assume within the shoe when the foot slides forward within the shoe when only the forward portion of the sole of the shoe engages a support surface.

FIG. 13 illustrates the position of a person's foot within the shoe 10 as it may appear when only the forward portion of the sole 14 engages the support surface in an abrupt stopping or jumping motion. The point of actual contact of the toe with the toebox and the center portion 22*a* of the cutout 22 are positioned the same in FIGS. 11 and 13, since the movement of the foot and engagement of the big toe with the toebox will be essentially the same in both instances.

As can be appreciated from the above discussion, the vertical position of the center 22*a* of the cutout 22 relative to the toebox 20 can vary along the vertical plane containing the longitudinal toe axis 23 from a position lying forward and directly in line with the longitudinal toe axis 23, to a forward position that is closer to the upper surface of the toebox 20, depending upon the point of actual impact that the big toe will have with the toebox.

Figure 15:
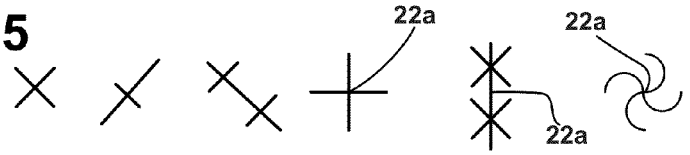
FIG. 15 is a diagrammatic illustration of examples of various alternative configurations of patterns of cuts made through the toebox material to form a cutout portion of the toebox.
Figure 16:
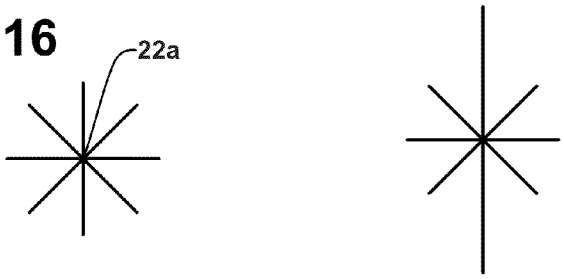
FIG. 16 is a diagrammatic illustration of examples of various alternative configurations of asterisk or starburst shaped cuts made through the toebox material to form a cutout portion of the toebox.

It should be noted that the term "cutout" does not necessarily mean that any toebox material has been removed from the shoe, but is intended to simply define that altered area of the toebox 20 corresponding to the point of actual impact, that provides a relief area for a rapidly advancing big toe. The cutout 22 portion can assume a variety of geometric shapes. A simple cutout 22 can be formed by a series of cuts or slots made through the toebox material similar to those self-administered "X" cuts to football shoes that have been made by football players in the past. Such cuts extend entirely through the toebox 20 material, generally cross one another and are of sufficient lengths such that the non-stretchable toebox material adjacent the cuts can separate when engaged by the big toe to form an opening through the toebox material into which the forward portion of the big toe can move. Such cuts are formed preferably in a crossing manner, wherein their intersection may correspond to the center portion 22*a* of the cutout and can be of virtually any shape and need not comprise straight lines, as illustrated in FIG. 15. In general, the more cuts that are made, without removing material from the toebox 20, and which cross at a single location also representing the point of actual impact, as well as cuts of greater length, serve to reduce resistance to movement of that toebox material located between adjacent cuts, facilitating opening of the passageway(s) for the big toe through the toebox material. The asterisk or starburst configuration of FIG. 16 would, for example, represent a fairly low resistance cutout 22 configuration where toebox material is not removed in the process forming a cutout. Resistance to "opening" the toebox material between adjacent intersecting cuts forming the cutout 22 results from the engaging toe being required to pivotally move that material adjacent the cuts out of the way of the advancement of the big toe to create and expand the opening upon impact of the toe with the cutout 22 portion of the toebox. The engaged cutout material generally moves in pivotal manner away from the center 22*a* of the cutout 22.

Figure 17:
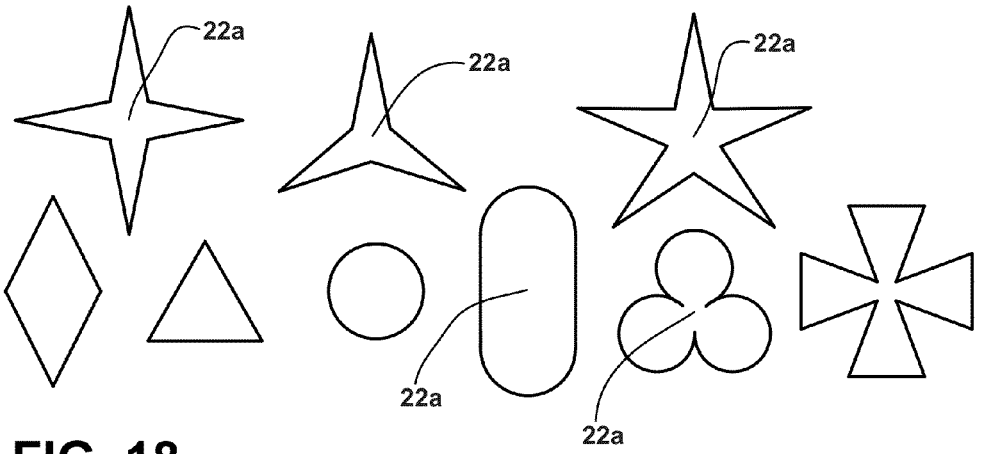
FIG. 17 is a diagrammatic illustration of examples of various alternative configurations of shapes of holes made through the toebox material in which material has been removed from the toebox to form the cutout portions of the toebox.
Figure 18:
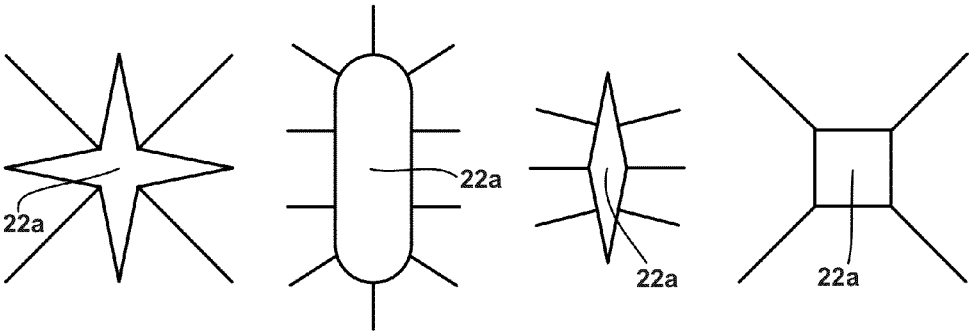
FIG. 18 is a diagrammatic illustration of examples of various alternative configurations of shapes of hybrid cutout configurations formed by both removal of toebox material combined with patterned cuts through the toebox material.

The cutout 22 can also assume various configurations wherein portions of the toebox material are actually removed, to initially form an open hole through the toebox. In the preferred embodiment illustrated in FIGS. 8-14, the cutout 22 is shaped in the form of a four point star. For such configurations as the four point star, the elongated portions of the removed material forming the star arms act like the cuts previously described, such that the toebox material adjacent and between the arms pivots away from the cutout center portion 22*a* when engaged by the big toe to form a larger generally rectangular opening to accommodate the big toe. However, the cutout 22 can be configured in any desired shape, including but not limited to arcuate configurations such as circles or ovals, polygons of varied configurations, etc., some examples of which are illustrated in FIG. 17. The cutout 22 configuration need not be limited to simple cuts or to open configurations, but can employ hybrid configurations thereof, as will be recognized by those skilled in the art. By way of example only, several hybrid cutout 22 configurations are illustrated in FIG. 18.

It is generally preferable to configure the cutout 22 into a shape that minimizes material removal while simultaneously minimizing resistance to penetration of the big toe into the cutout opening created during opening of the cutout. Any toebox material remaining in the cutout area adjacent any material removal areas or cuts formed through the toebox material, serves to partially close the passageway through the cutout when it is not being engaged by the big toe, to provide some measure of protection to the toes and foot similar to that which would have been provided by the toebox material had it not been cut or removed. The size and shape of the opening provided through the cutout 22 area will vary depending upon the configuration and orientation of the cuts and material removed from the toebox. Preferably, the cutout should be formed in a manner so as to allow relatively impact free penetration of the big toe (except for the damping resistance applied to the toe by the stretchable layer or web material hereinafter described) through the cutout opening formed in the toebox material and beyond the front of the toebox 20 by a longitudinal distance of at least about ⅛ of an inch. More preferably, such distance would be at least about ¼ of an inch, and even still more preferably, such distance would be at least about ½ inch and could go even further, to 1.0 inch or more. It will be understood that the language of "at least" used herein and in the claims is not intended to be a limitation that would exclude the designated denominations (i.e., ⅛ inch, ¼ inch, ½ inch etc.), which are intended to be included within the recited ranges.

In the preferred embodiment, a stretchable layer or web member 24 is secured to the toebox 20 in a manner so as to lie across the cutout portion 22 of the toebox. The stretchable layer 24 is peripherally secured around the cutout 22 by stitching or other appropriate securement methods so as to block access of foreign matter through the cutout 22 from outside of the toebox 20 while permitting the cutout to open as designed when forcibly engaged by the big toe to the peripheral extent permitted by the cutout 22 pattern and the passageway created thereby. Those portions of the cutout 22 that are permitted to move upon contact and forward movement of the big toe will be displaced to the extent permitted by their remaining connections to the toebox and the stretchability of the web material 24 to "open" the cutout passageway for the big toe as it progresses into and through the passageway. The web material 24 will stretch outwardly to the extent permitted by its elasticity, to enable the big toe to advance into and through the cutout 22 passageway created, and beyond the forward outer peripheral wall surface of the less stretchable or nonstretchable material forming the toebox. Upon removal of forward outward movement pressure from the big toe, the web material 24 will retract or unstretch back to its original position across the cutout. In such original position, the web material may still be in a partially stretched condition as extended across the cutout opening. The web material 24 may be of any shape, not necessarily the same as that of the underlying cutout, but should be sized appropriately larger than the cutout periphery to permit proper functioning of the cutout 22 material movement as it opens a passageway in response to pressure exerted by the big toe, to open to the full extent permitted by the cutout configuration. In the preferred embodiment illustrated in FIGS. 8, 9 and 14, the web 24 is configured in the same general four point star shape as the peripheral shape of the underlying cutout 22, but has a proportionately larger footprint which outlies that of the cutout 22. The stretchable web layer is preferably peripherally secured to the toebox around the periphery of the cutout 22 and may be secured to either the inner or outer surfaces of the less stretchable portion of the toebox or in an interleaved or other manner with the toebox material. The stretchable material may preferably be secured by stitching to the surrounding toebox material. The stretchable material could also comprise, for example, part of a larger portion of the shoe such as a shoe liner material that could have a portion thereof appropriately secured to the toebox around the cutout 22.

In a preferred embodiment, the stretchable web material 24 is configured in part from an elastic material that stretches to conform to the shape of the front part of the advancing toe and to the extent of forward movement of the big toe as it engages the cutout portion of the toebox. The web 24 is of sufficient thickness to permit proper attachment strength, preferably by stitching to the underlying toebox 20 material. The web 24 is also preferably constructed of porous material that can breathe to allow ventilation of air into the toebox. The porosity may be provided by the nature of the material itself, or could be derived from a material which includes small holes or pores formed therethrough that provide increased ventilation and breathability through the web material and potentially increasing stretchability of the web material. While the web material 24 is porous to ventilating air the pores are small enough to prevent or inhibit infiltration of dirt, sand and other debris through the cutout and into the toebox 20. This is particularly significant when the shoe is used on artificial turf fields which use fillers that can create abrasions with concomitant risk of infections and other foot/toe injuries such as blisters, torn skin, damage to toenails, etc., if they get into the shoe 10.

In the preferred embodiment, the web material is capable of multi-directional stretching and may comprise any appropriate stretchable material, but in the preferred embodiment is formed from a combination of a condensation polymer material with an elastic material. The polymer material is preferably nylon and the elastive material is preferably spandex, elastene or other elastic material. It will be understood by those skilled in the art that other materials could be used in place of nylon, including for example, and not by way of limitation, polyesters, polycarbonates, or thin neoprene. The preferred embodiment web material 24 uses a ply nylon and elastive material combination that besides providing the desired stretch, provides a relatively low friction inner surface that is engagable by any movable portions of the cutout 22 as they move to open and close the cutout passageway for movement of the big toe relative thereto. As shown in FIG. 12, the stretchable web material 24 stretches to conform to the shape of the toe advancing into the cutout 24 passageway while simultaneously damping or providing gently increasing resistance to slow the forward movement of the toe within the passageway. Besides offering low resistance to opening of the cutout 22 passageway and to the forward movement of the big toe through the passageway, the elastic nature of the web allows the web to retract back to its initial unstretched condition upon removal of the big toe from the cutout passageway. As the web 24 retracts, it urges the movable portions of the cutout 22 back to their at-rest positions, forming with the web 24 a protective closed or semi-closed surface across the cutout portion of the toebox that would otherwise be exposed. The web 24 also prevents or limits undesirable expansion of the cutout 22 size over time to help prevent premature breakdown of the toebox material, thereby maintaining the integrity of the toebox. The ply nylon can be for example, two-ply or three-ply nylon. The ply nylon and elastive material should be in a ratio that permits the desired multi-directional stretch necessary for achieving the purposes of the invention of allowing the wearer's toe to sufficiently penetrate through the cutout and beyond the outer peripheral surface of the toebox as previously described. The ply nylon and elastic material should preferably be in a ratio that permits the desired multi-directional stretch necessary for the invention. The ratio of ply nylon to elastive can vary, depending on the sport with which the shoe will be used and the particular shoe configuration and other materials used in its construction, but can for example, be in the range of about 50% to about 50%; about 60% to about 40%; about 70% to about 30%; about 80% to about 20%; about 90% to about 10%; about 95% to about 5%; and about 97% to about 3%, respectively.

The web material 24 may also, for example, be made of a thermoplastic elastomer (TPE), a synthetic material, leather or textile which can stretch to conform to the forward movement of the big toe and past the normal outer forward peripheral surface of the toebox, while satisfying the functional aspects of the invention heretofore described.

The web material 24 material could be imprinted with indicia, team or personal logos or trademarks or the like, adding to the aesthetic nature of the shoe. Since the stretchable web material does not necessarily have to conform to the peripheral shape of the cutout if secured externally to the toebox, the external shape of the web material could itself be configured in the shape of a preferred logo, design, or the like, as could the shape of the cutout itself.

FIG. 10 illustrates a diagrammatic cross-sectional view of a shoe 10 configured according to the principles of this invention, illustrating a person's foot as it would be positioned within the shoe at an "at-rest" position. It will be noted that in the rest position, the forward portion of the big toe is spaced back from the forward part of the toebox 20 which includes the cutout 22 and overlying web material 24. FIG. 11 illustrates the same shoe as that of FIG. 10, with the foot shown moved to a forward position as it may occur when the shoe is engaging an underlying surface during a stop or cutting motion. The toe is shown in engagement with the cutout 22 in the toebox 20 and is illustrated as it might appear when pushing through the cutout portion and expanding the stretchable web material 24 beyond the front peripheral surface of the toebox 20 to relieve pressure on the toe that would otherwise be imparted to the toe by the forward portion of the toebox. FIG. 13 illustrates a similar movement of the foot within the shoe that might occur when the abrupt stopping or cutting or jumping motion of the foot happens when only the toe or front portion of the sole 14 engages the underlying support surface. As was the case in the illustration of FIG. 11, the big toe of the foot has opened the cutout 22 and progressed beyond the forward surface of the toebox as permitted by the elasticity of the stretchable web material 24.

Figure 14:
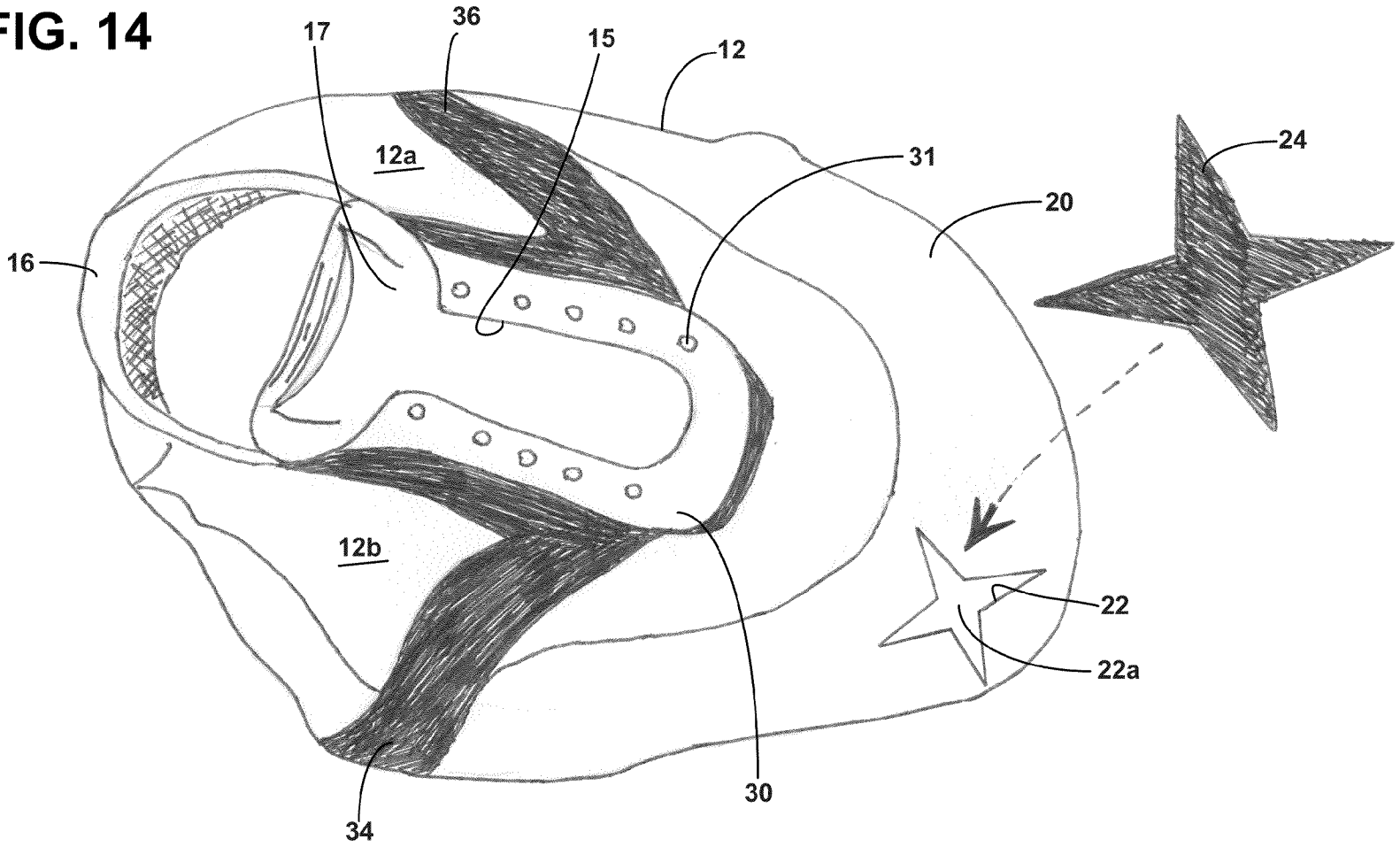
FIG. 14 is a top perspective view of the upper, tongue and heel counter portions of the shoe of FIG. 9, as they might appear when assembled together and prior to their collective assembly to a sole of the shoe.

Referring to FIG. 14, it is anticipated that one method of manufacture of a shoe according to the principles of this invention may be to secure the stretchable web material 24 to the external or internal surface in the toebox while the upper or vamp is still in a relatively flat or pattern configuration. Such a pattern configuration of the vamp of the preferred embodiment shoe 10, is shown, illustrating the star shaped cutout 22 therein as it might appear prior to attachment or docking to the sole 14 to form a completed shoe. The size of the overlying or underlying web material 24 may be significantly larger than the external periphery of the cutout 22, to allow for proper expansion of the cutout 22 and penetration of the big toe into and through the cutout to the extent required by the force exerted on the cutout portion and overlying web by the advancing big toe.

While the invention has been illustrated with reference to one preferred embodiment construction as applicable to a shoe configured for football and with reference to particular materials used for its construction, it will be appreciated by those skilled in the art that other constructions and materials and modifications of the invention not specifically disclosed or referred to herein can be used without departing from the spirit and intent of the invention, and that the principles of the invention apply to athletic shoes configured for sports other than football. Further, while the invention has been described in association with protection of a big toe of a foot, the principles of the invention are not limited to us in protecting the big toe but are equally applicable for protecting other selected toes of the foot. Those skilled in the art will recognize how to adapt the inventive principles to shoe configurations designed to protect toes other than the hallux.

By way of example only, while an athletic shoe employing a cutout in combination with a stretchable elastic material has been described in association with one preferred embodiment of the invention, the invention is not limited to a toebox configuration employing a cutout. An embodiment of a shoe having a toebox configured from materials of differing elasticity selectively positioned relative to one another in the toebox construction could also practice the invention. In such a toebox construction a majority of the toebox might be constructed from a material having no or relatively little stretchability, with that portion of the toebox corresponding to the point of actual impact of the toe to be protected with the toebox, and a sufficient amount of surrounding toebox material laterally extending beyond the point of actual impact to an extent sufficient to form a passageway for the toe, being constructed from a material of relatively high stretchability or elasticity. In such construction the highly stretchable material performs both functions of defining a passageway for the toe beyond the normal outer surface of the toebox, while containing and damping forward movement of the toe as it progresses forwardly against the bias of the stretchable material.

This disclosure is intended to provide specific examples of preferred embodiment structures and applications that clearly disclose an apparatus and method applicable to the present invention and its operative principles. Accordingly, the invention is not to be limited to any particular embodiment or configuration or component parts thereof or to the use of any particular materials for their construction. All alternatives, modifications and variations of the present invention which fall within the broad scope of the appended claims are covered.

What is claimed is:

1. An athletic shoe sized, arranged and configured to operatively house a person's foot of a predetermined size and shape, comprising;

a. a sole;

b. an upper operatively connected to said sole to form a shoe for said foot, said upper having a forward toebox portion comprising generally non-stretchable material configured to house toes of said foot; said toebox defining a point of actual impact for a selected advancing toe of said foot; said point of actual impact being that predetermined position along said toebox at which said selected advancing toe of said foot for which the shoe was designed, will primarily forcibly engage an inner surface of said toebox when said foot abruptly moves forward within said shoe;

c. said toebox defining a cutout portion formed through said generally non-stretchable toebox material and generally centered about said point of actual impact, said cutout portion defining a passageway through and surrounded by said generally non-stretchable material; said passageway being sized and configured to receive and enable at least a forward portion of said selected advancing toe for which said shoe was designed to move into and through said passageway and beyond an outer peripheral surface of said surrounding non-stretchable toebox material; and d. a stretchable layer operatively connected to said generally non-stretchable toebox material and extending across said cutout passageway, having elasticity sufficient to enable said selected advancing toe to move into and through said passageway against the bias of said stretchable layer.

2. An athletic shoe according to claim 1, wherein said stretchable layer is secured to an inner surface of said toebox portion.

3. An athletic shoe according to claim 1, wherein said stretchable layer is secured to said toebox portion by stitching.

4. An athletic shoe according to claim 1, wherein said stretchable layer comprises porous material of a type suitable for providing ventilation to the inside of said toebox portion through said cutout passageway while blocking entry of particulate debris and foreign matter into said toebox portion through said cutout passageway.

5. An athletic shoe according to claim 1, wherein said cutout portion comprises at least in part, a plurality of intersecting cuts through said generally non-stretchable toebox material.

6. An athletic shoe according to claim 5, wherein said cutout portion includes said generally non-stretchable toebox material between adjacent ones of said intersecting cuts, that are pivotally movable to define or enlarge said passageway in response to outward stretching movement of said stretchable layer when operatively engaged by movement of said advancing selected toe.

7. An athletic shoe according to claim 1, wherein said stretchable layer comprises at least in part, elastive fibers.

8. An athletic shoe according to claim 7, wherein said stretchable layer comprises a combination of elastive fibers and condensation polymer material, and is capable of multidirectional stretching.

9. An athletic shoe according to claim 1, wherein said stretchable layer has elasticity sufficient to enable an outer surface of said stretchable layer to be pushed through said cutout passageway by said selected advancing toe beyond said outer peripheral surface of said toebox material by at least about ⅛ inch or more.

10. An athletic shoe, according to claim 1, wherein said cutout portion is defined in part by portions of removed said non-stretchable material from said toebox and in part by cuts through said toebox material, extending from said removed toebox material portions.

11. An athletic shoe according to claim 1, wherein said cutout portion is defined at least in part by a portion of said non-stretchable toebox material being removed from said toebox portion.

12. An athletic shoe according to claim 11, wherein said cutout portion is configured in the shape of a geometric pattern having a plurality of outwardly projecting lobes.

13. An athletic shoe according to claim 12, wherein the lobes of said cutout portion are generally of like configuration.

14. An athletic shoe according to claim 1, wherein said cutout portion comprises a combination of cuts formed through said toebox material and selected areas where said non-stretchable material has been removed from said toebox.

15. An athletic shoe according to claim 1, wherein said cutout portion is configured by cuts through and/or removed portions of said generally non-stretchable material in coordinated manner such that at least some of said generally non-stretchable material in said cutout portion is operatively connected with and moves in response to movement of said stretchable layer to expand and contract the cross-sectional size of said passageway.

16. An athletic shoe according to claim 15, wherein when said stretchable layer retracts toward its initial configuration, movable non-stretchable portions of said cutout portion that are operatively connected to said stretchable material move back to their initial positions to reduce the size of said cutout passageway.

17. An athletic shoe according to claim 1, wherein said cutout portion is configured in the shape of a logo.

18. An athletic shoe according to claim 9, wherein said stretchable layer has elasticity sufficient to enable said outer surface thereof to be pushed through said cutout passageway and beyond said outer peripheral surface of said toebox material by at least about ¼ inch or more.

19. An athletic shoe according to claim 9, wherein said stretchable layer has elasticity sufficient to enable said outer surface thereof to be pushed through said cutout passageway and beyond said outer peripheral surface of said toebox material by at least about ½ inch or more.

20. An athletic shoe of a type arranged and configured for use in an athletic sport and proportionately arranged, sized and configured to receive a human foot, comprising:

a. a sole extending along the bottom portion of the shoe;

b. an upper, operatively connected to said sole, said upper including a toebox at a forward end thereof configured to operatively enclose the toes of said foot, including a big toe thereof; said toebox having at least a forward portion thereof constructed of a material having generally uniform properties across said forward portion;

c. said toebox defining a cutout portion formed through at least said forward portion of said toebox; said cutout portion being generally aligned with said big toe of said foot so as to be generally centrally engaged by a forward end of said big toe when said big toe abruptly moves is a forward direction within said shoe; said cutout portion being configured to define an opening through said toebox material sized to allow passage of at least said forward portion of said big toe therethrough to an extent such said forward toe portion extends through and forward of an outer front peripheral surface of the toebox;

d. a cover of stretchable material operatively secured to said toebox so as to cover at least a maximum peripheral opening extent of said cutout portion, and having an elasticity sufficient to enable said big toe to advance into and through said cutout opening while imparting damping resistance to said advancing toe; said elasticity of said stretchable material being significantly higher than that material of said toebox forward portion; and e. wherein said cutout portion includes segments of said toebox material that pivotally move outwardly against the bias of said stretchable cover material when engaged by said big toe advancing in a forward direction, to enlarge the size of the cutout opening as the big toe advances.

21. The shoe of claim 20, wherein an inner directed surface of said stretchable cover offers minimal sliding friction to said pivotally moving segments of said cutout as they move to enlarge the size of the cutout opening.

22. An athletic shoe arranged and configured to house a foot of predetermined size and shape, said shoe having a forward toebox portion designed, arranged and configured to contain toes of said foot, said foot having at least one selected toe configured to extend along a longitudinal toe axis extending from a first metatarsophalangeal joint (MPJ) and centrally forward through proximal and distal phalanges of the selected toe; said shoe being arranged and configured to orient said foot for some forward and backward movement within said shoe such that said longitudinal toe axis of said selected toe moves within a generally vertical plane and such that the intersection of said longitudinal toe axis with said toebox at a predetermined forward impact position of said selected toe with said toebox generally defines a toe impact area on said toebox; said shoe further comprising:

a. said toebox being generally constructed of non-stretchable material;

b. said toebox having a cutout portion generally centered about said toe impact area of said toebox and surrounded by said non-stretchable material, said cutout portion defining a passageway through said non-stretchable material being sized and configured to allow penetration of a forward portion of said selected toe through said passageway and beyond a normal outer peripheral surface of said non-stretchable toebox material;

c. a stretchable layer operatively connected to said toebox non-stretchable material and extending across said cutout passageway, having elasticity sufficient to enable at least a portion of said advancing selected toe to move into and through said passageway against the bias of said stretchable layer.

* * * * *